US009962937B2

(12) United States Patent
Okushima et al.

(10) Patent No.: US 9,962,937 B2
(45) Date of Patent: May 8, 2018

(54) LIQUID EJECTION HEAD AND LIQUID EJECTION DEVICE

(71) Applicant: CANON KABUSHIKI KAISHA, Tokyo (JP)

(72) Inventors: Shingo Okushima, Kawasaki (JP); Seiichiro Karita, Saitama (JP); Takatsuna Aoki, Yokohama (JP); Noriyasu Nagai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/390,847

(22) Filed: Dec. 27, 2016

(65) Prior Publication Data

US 2017/0197421 A1 Jul. 13, 2017

(30) Foreign Application Priority Data

Jan. 8, 2016 (JP) ..... 2016-002944
Dec. 6, 2016 (JP) ..... 2016-236639

(51) Int. Cl.
*B41J 2/155* (2006.01)
*B41J 2/21* (2006.01)
*B41J 2/14* (2006.01)

(52) U.S. Cl.
CPC ..... *B41J 2/155* (2013.01); *B41J 2/1404* (2013.01); *B41J 2/14016* (2013.01); *B41J 2/2146* (2013.01); *B41J 2202/20* (2013.01); *B41J 2202/21* (2013.01)

(58) Field of Classification Search
CPC .... B41J 2/155; B41J 2/14016; B41J 2/14145; B41J 2/1404; B41J 2202/20
See application file for complete search history.

(56) References Cited

U.S. PATENT DOCUMENTS 5,826,333 A 10/1998 Iketani et al.
5,933,163 A 8/1999 Koizumi et al.
6,116,714 A 9/2000 Imanaka et al.
6,168,254 B1 1/2001 Karita et al.
(Continued)

FOREIGN PATENT DOCUMENTS

JP 4495762 B2 7/2010
JP 4824795 B2 11/2011

OTHER PUBLICATIONS

U.S. Appl. No. 15/383,204, Shingo Okushima, Seiichiro Karita, Takatsuna Aoki, Noriyasu Nagai, Eisuke Nishitani, Yumi Komamiya, filed Dec. 19, 2016.
(Continued)

*Primary Examiner* — Julian Huffman
(74) *Attorney, Agent, or Firm* — Fitzpatrick, Cella, Harper & Scinto

(57) ABSTRACT

A liquid ejection head includes first and second recording element boards having recording elements for generating energy to be utilized for ejection of liquid, first and second support members for respectively supporting the first and second recording element boards, and a flow channel forming member carrying thereon the first and second support members arranged side by side. The edge of the first recording element board located at the side of the second recording element board projects toward the second recording element board from the edge of the first support member located at the side of the second support member.

24 Claims, 24 Drawing Sheets

(56) References Cited

U.S. PATENT DOCUMENTS

| | | | | |
|---|---|---|---|---|
| 6,331,051 | B1 | 12/2001 | Tajima et al. | |
| 7,413,300 | B2 * | 8/2008 | Von Essen | B41J 2/145 347/89 |
| 7,416,629 | B2 | 8/2008 | Silverbrook et al. | |
| 7,469,987 | B2 | 12/2008 | Silverbrook et al. | |
| 7,571,541 | B2 | 8/2009 | Silverbrook et al. | |
| 7,736,458 | B2 | 6/2010 | Silverbrook et al. | |
| 7,776,175 | B2 | 8/2010 | Silverbrook et al. | |
| 2002/0001020 | A1 * | 1/2002 | Mrvos | B41J 2/14072 347/65 |
| 2006/0152557 | A1 | 7/2006 | Silverbrook et al. | |
| 2015/0197089 | A1 | 7/2015 | Karita et al. | |

OTHER PUBLICATIONS

U.S. Appl. No. 15/338,430, Shingo Okushima, Seiichiro Karita, Takatsuna Aoki, Noriyasu Nagai, Eisuke Nishitani, Yoshiyuki Nakagawa, filed Dec. 22, 2016.

U.S. Appl. No. 15/388,792, Shingo Okushima, Takatsuna Aoki, Seiichiro Karita, Noriyasu Nagai, Tamaki Ishikawa, Yasuaki Tominaga, Manabu Otsuka, Shuzo Iwanaga, Tatsurou Mori, Kazuhiro Yamada, Akira Yamamoto, Zentaro Tamenaga, Akio Saito, filed Dec. 22, 2016.

* cited by examiner

LIQUID EJECTION HEAD AND LIQUID EJECTION DEVICE

BACKGROUND OF THE INVENTION

Field of the Invention

Liquid ejection devices such as inkjet printers are being employed not only for home use printing but also for commercial printing such as business use printing and retail photo printing, and for industrial printing applications including electronic circuit drawing and panel display manufacturing. High speed printing capabilities are strongly required for liquid ejection devices, particularly in the field of business use printing. Efforts are being made to realize commercially viable line type liquid ejection heads that have a width greater than the widths of recording mediums to be used with the heads and hence a greater number of liquid ejection ports than ever in order to achieve higher speed printing.

Liquid ejection heads to be formed by arranging a plurality of recording element boards, each having a plurality of ejection ports, in the longitudinal direction of the liquid ejection head have been proposed as techniques for realizing liquid ejection heads having a broader width.

The specification of Japanese Patent No. 4,495,762 discloses a technique of arranging a plurality of recording element boards in a row in the longitudinal direction of a liquid ejection head. The specification of Japanese Patent No. 4,824,795 describes a technique of preparing a plurality of ejection modules, each having a recording element board and a support member supporting the recording element board, and mounting the plurality of ejection modules on a supporting plate in a state where the ejection modules are individually dismountable. With this technique, if a specific one of the ejection modules falls into trouble, only the module in trouble can be replaced.

When ejection modules are arranged in a row in a condition where they are individually dismountable by using either the technique described in the specification of Japanese Patent No. 4,495,762 or the one described in the specification of Japanese Patent No. 4,824,795, the minimal distance between any two adjacently located recording element boards is limited by the levels of processing accuracy and of mounting position alignment accuracy of the support members because these accuracy levels are low. This problem can give rise to instances where the distance between any two adjacently located recording element boards cannot satisfactorily be reduced.

When the distance separating any two adjacently located recording element boards cannot be made satisfactorily short, the width of displacement of the rows of ejection ports arranged on the two recording element boards in neighboring areas can become remarkably large as viewed in the scanning direction and the gap separating the rows of ejection ports arranged on the two recording element boards can become intolerably large as viewed in the longitudinal direction. Then, as a result, the recorded image obtained by using a liquid ejection head having such drawbacks can represent unevenness on the recorded image in areas that correspond to neighboring areas of recording element boards.

SUMMARY OF THE INVENTION

In view of the above-identified problems of the prior art, the object of the present invention is therefore to provide a liquid ejection head and a liquid ejection device in which the distance between any two adjacently located recording element boards can be reduced more than ever.

According to the present invention, there is provided a liquid ejection head including: first and second recording element boards having recording elements for generating energy to be utilized for ejection of liquid; first and second support members for respectively supporting the first and second recording element boards; and a flow channel forming member carrying thereon the first and second support members arranged side by side, wherein the edge of the first recording element board located at the side of the second recording element board projects toward the second recording element board from the edge of the first support member located at the side of the second support member.

Further features of the present invention will become apparent from the following description of exemplary embodiments with reference to the attached drawings.

DESCRIPTION OF THE EMBODIMENTS

Figure 1:
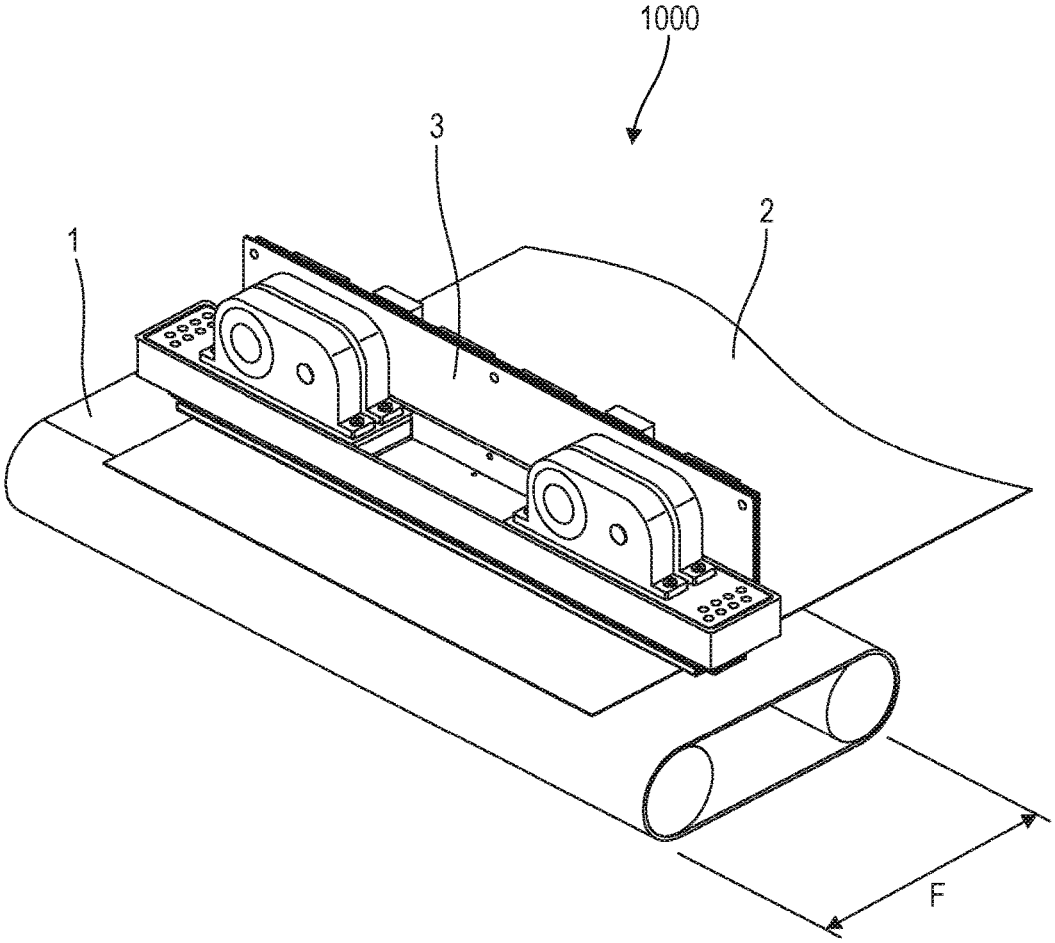
FIG. 1 is a schematic illustration of the liquid ejection device of Use Example 1 of the present invention, schematically representing the configuration thereof.

Now, the present invention will be described in greater detail by way of use examples and embodiments of the present invention and by referring to the accompanying drawings. Note, however, that the description given below by no means limits the scope of the present invention. The liquid ejection heads of the embodiments that are described below are realized by using thermal type recording elements that are heat generating elements designed to generate air bubbles to eject liquid, although piezoelectric type or some other liquid ejection type recording elements may alternatively be employed for the purpose of the present invention. A liquid ejection head for ejecting liquid such as ink according to the present invention and a liquid ejection device including such a liquid ejection head can find applications in the field of printers, copying machines, facsimile machines having a telecommunication system and word processors having a printer section. Furthermore, they also can find applications in the field of industrial recording apparatus formed by compositely combining a liquid ejection device according to the present invention with any of various processing devices. For example, they can find applications in the field of producing biochips, in the field of electronic circuit printing, in the field of semiconductor substrate production and so on.

While a mode of realization of the present invention where liquid such as ink is made to circulate between a storage tank and a liquid ejection head is adopted in each of the Use Examples that will be described below, any other mode of realization of the present invention may alternatively be adopted. In a different mode of realizing the present invention, for example, the liquid ejection head may be provided with two storage tanks and one of them is arranged at the upstream side while the other one is arranged at the downstream side of the liquid ejection head and liquid is made to flow from the upstream side one of the tanks to the downstream side one in order to cause the liquid in the pressure chambers of the liquid ejection head to flow without causing the fluid to circulate.

In each of the Use Examples that will be described below, a so-called line type (page wide type) liquid ejection head having a length that corresponds to the width of the recording medium to be used with the liquid ejection head is adopted. However, a so-called serial type liquid ejection head designed to execute a recording operation while it is scanning the recording medium to be used for the recording operation may alternatively be adopted. An exemplar serial type liquid ejection head is typically but non-limitatively mounted with recording element boards including a recording element board for black ink and recording element boards for respective color inks. Alternatively, a serial type liquid ejection head may include a plurality of recording element boards that are arranged such that the rows of ejection ports thereof partly overlap in the direction of the rows of ejection ports and have a width greater than the width of the recording medium to be used with the liquid ejection head.

(Use Example 1)

(Explanation of the Inkjet Recording Apparatus)

FIG. 1 is a schematic illustration of the liquid ejection device of Use Example 1, schematically representing the configuration thereof that can be realized by applying the present invention. The liquid ejection device illustrated in FIG. 1 is an inkjet recording apparatus 1000 (to be also referred to simply as recording apparatus hereinafter). The recording apparatus 1000 includes a conveying section 1 for conveying recording mediums 2 and a line type liquid ejection head 3 arranged substantially orthogonal relative to the direction in which a recording medium 2 is conveyed and is designed as a one-pass recording apparatus that continuously executes recording operations with a single pass, while conveying the recording mediums 2 continuously or intermittently. The recording medium 2 may be in the form of a roll of paper or in the form of sheets of paper. The liquid ejection head 3 can operate for full color printing, using CMYK inks (cyan ink, magenta ink, yellow ink and black ink) as liquid. As will be described hereinafter, the liquid ejection head 3 is fluidically connected to liquid supply means which are supply channels for supplying the liquid ejection head with liquid as will be described hereinafter, main tanks and buffer tanks (see FIG. 2). The liquid ejection head 3 is additionally electrically connected to an electric control section that transmits electric power and logic signals to the liquid ejection head 3. The liquid flow route and the electric signal transmission route in the liquid ejection head 3 will be described hereinafter.

(Explanation of the First Circulation Route)

Figure 2:
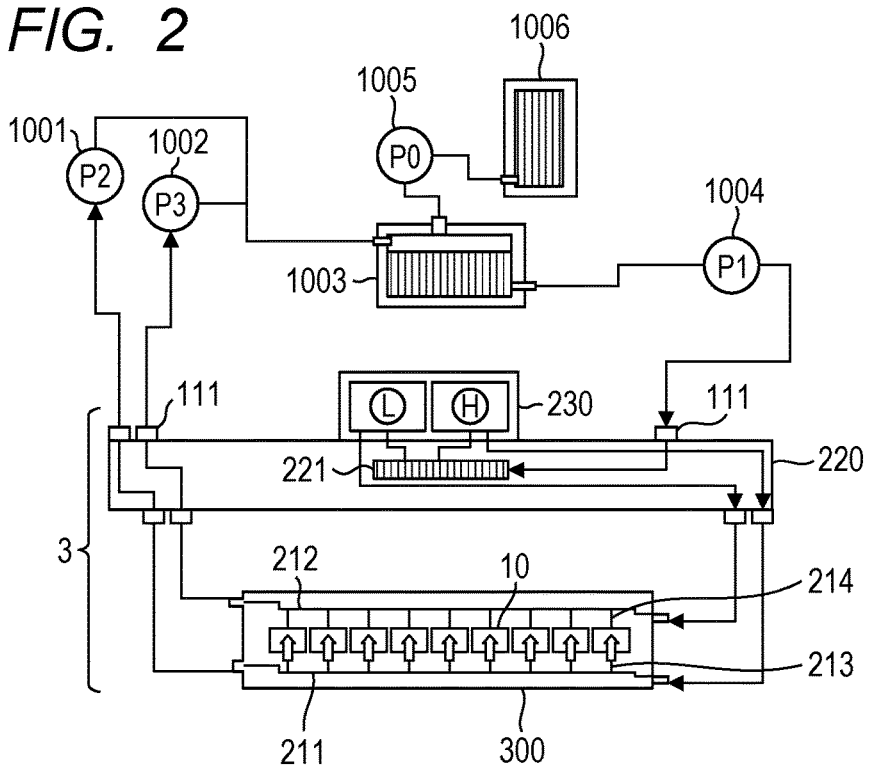
FIG. 2 is a schematic illustration of the first circulation route in Use Example 1 of the present invention.

Now, the circulation routes for circulating liquid that are applied to the recording apparatus of this Use Example will be explained below. FIG. 2 is a schematic illustration of the first circulation route for circulating liquid, representing a mode of realization of circulation route applicable to the recording apparatus of this Use Example. Referring to FIG. 2, the liquid ejection head 3 is fluidically connected to first circulation pump (high pressure side) 1001, first circulation pump (low pressure side) 1002 and buffer tank 1003. While only the route through which one of CMYK inks flows is illustrated in FIG. 2 for the purpose of simplification, in reality a total of four sets of circulation routes for inks of the four colors are arranged in the liquid ejection head 3 and the recording apparatus 1000 main body.

The buffer tank 1003, which is provided so as to operate as sub-tank, is connected to main tank 1006. The buffer tank 1003 has an air communication port (not illustrated) for establishing communication between the inside of the tank and the atmosphere so as to discharge air bubbles in the ink in the buffer tank to the outside. The buffer tank 1003 is additionally connected to replenishment pump 1005. When liquid is consumed in the liquid ejection head 3 as a result of an operation of ejecting or discharging liquid from the ejection ports of the liquid ejection head 3, the replenishment pump 1005 operates to transfer ink from the main tank 1006 to the buffer tank 1003 to compensate the consumed amount of ink. Operations of ejecting and discharging liquid typically include recording operations and suction recovery operations.

The two first circulation pumps 1001 and 1002 that are liquid transportation means have a function of drawing liquid from liquid connection sections 111 of the liquid ejection head 3 and flowing it down to the buffer tank 1003. The first circulation pumps are preferably positive displacement pumps that are capable of quantitatively feeding liquid. More specifically, pumps that may preferably be selected for the first circulation pumps include tube pumps, gear pumps, diaphragm pumps and syringe pumps. For example, they may be of the type having a constant flow rate valve and a relief valve that are popularly known and arranged at the pump outlet so as to secure a constant flow rate. When the liquid ejection head 3 is driven to operate, liquid is made to flow at a constant flow rate through common supply channel 211 and common collection channel 212 respectively by the first circulation pump (high pressure side) 1001 and the first circulation pump (low pressure side) 1002. The liquid flow rate is preferably so selected as to be found above the flow rate level below which the temperature differences among the recording element boards 10 in the liquid ejection head 3 adversely affect the quality of the images recorded by the inkjet recording apparatus. However, if a too large flow rate is selected, the negative pressure differences among the recording element boards 10 become too large under the influence of the pressure loss in the flow channels in the liquid ejection head 3 to give rise to a problem of uneven density on the recorded image. Therefore, the flow rate is preferably selected by taking both the temperature differences and the negative pressure differences among the recording element boards 10 into consideration.

Negative pressure control unit 230 is arranged between second circulation pump 1004 and liquid ejection unit 300. The negative pressure control unit 230 operates such that, when the flow rate in the circulation route fluctuates due to a recording duty difference, it confines the pressure at the downstream side of the negative pressure control unit 230 within a predetermined range that is centered at a preselected and desired pressure level. The downstream side of the negative pressure control unit 230 is the side located closer to the liquid ejection unit 300 than to the negative pressure control unit 230. The negative pressure control unit 230 has two pressure regulators in which mutually different respective control pressures are preselected and preset. The two pressure regulators are not subjected to any particular limitations provided that each of them can control the pressure at the downstream side thereof so as to confine any fluctuations of the pressure within a predetermined range that is centered at a preselected and desired pressure level. So-called "pressure reducing regulators" may be adopted for the pressure regulators. When pressure reducing regulators are employed for the pressure regulators, pressure is preferably applied to the upstream side of the negative pressure control unit 230 by means of the second circulation pump 1004 and by way of liquid supply unit 220 as illustrated in FIG. 2. Such an arrangement can raise the degree of freedom of laying out the buffer tank 1003 in the recording apparatus 1000 because the arrangement can suppress the influence of the head pressure of the buffer tank 1003 on the liquid ejection head 3. The second circulation pump 1004 is only required to represent head pressure not lower than a predetermined pressure level within the range of flow rate of circulating ink that is observed when the liquid ejection head 3 is driven to operate. For example, a turbo pump or a positive displacement pump may be used for the second circulation pump 1004. More specifically, a diaphragm pump may be selected for the second circulation pump 1004. Alternatively, the second circulation pump 1004 may be replaced by a water header tank that is so arranged as to represent a predetermined water head difference relative to the negative pressure control unit 230.

With regard to the two pressure regulators, the pressure regulator in which relatively higher output pressure is preselected and the pressure regulator in which relatively low output pressure is preselected are respectively connected to the common supply channel 211 and the common collection channel 212 in the liquid ejection unit 300 by way of the inside of the liquid supply unit 220. In FIG. 2, the pressure regulator with relatively high preselected output pressure is indicated by H, whereas the pressure regulator with relatively low preselected output pressure is indicated by L. The common supply channel 211, the common collection channel 212, individual supply channels 213 that communicate with respective recording element boards and individual collection channels 214 that also communicate with respective recording element boards are arranged in the liquid ejection unit 300. The individual supply channels 213 and the individual collection channels 214 respectively communicate with the common supply channel 211 and the common collection channel 212. Due to this arrangement, part of the liquid that flows through the common supply channel 211 then flows from the common supply channel 211 to the common collection channel 212 by way internal flow channels in the inside of the recording element boards 10 (as indicated by arrows in FIG. 2). This is because the pressure regulator H with relatively high preselected output pressure is connected to the common supply channel 211 and the pressure regulator L with relatively low preselected output pressure is connected to the common collection channel 212 to consequently give rise to a pressure difference between the two common channels (the common supply channel 211 and the common collection channel 212).

As described above, in the liquid ejection unit 300, liquid flows through both the common supply channel 211 and the common collection channel 212 so as to give rise to flow paths in the respective recording element boards 10 through which part of the liquid flows. Then, as a result, the heat generated in the recording element boards 10 can be discharged to the outside of the recording element boards 10 by means of the part of the liquid that flows through the common supply channel 211 and the common collection channel 212. Additionally, with the above-described arrangement, while the liquid ejection head 3 is being driven for a recording operation, liquid is made to flow through the ejection ports and the pressure chambers that are not in operation so as to suppress any possible rise of ink viscosity that can take place at those sites. Additionally, liquid with increased viscosity and foreign objects contained in the liquid, if any, can be discharged to the common collection channel 212. Thus, this arrangement allows the liquid ejection head 3 of this Use Example to record high quality images at high speed.

(Explanation of the Second Circulation Route)

Figure 3:
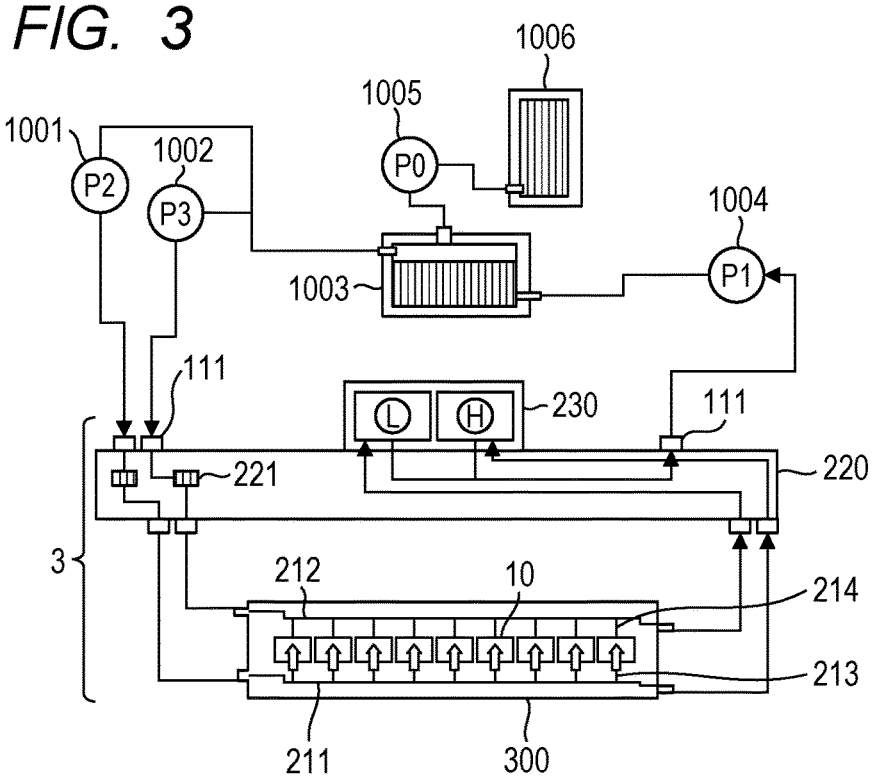
FIG. 3 is a schematic illustration of the second circulation route in Use Example 1 of the present invention.

FIG. 3 is a schematic illustration of the second circulation route in Use Example 1 of the present invention, which differs from the above-described first circulation route but also can be applied to a recording apparatus according to the present invention. The second circulation route differs from the first circulation route mainly in that both of the two pressure regulators of the negative pressure control unit 230 control the pressure at the upstream side of the negative pressure control unit 230. In other words, both of the two pressure regulators operate to confine the pressure at the upstream side of the negative pressure control unit 230 within a predetermined range that is centered at a preselected and desired pressure level (just like the operation of so-called "back pressure regulators"). The second circulation route also differs from the first circulation route in that the second circulation pump 1004 operates as negative pressure source for reducing the pressure at the downstream side of the negative pressure control unit 230. The second circulation route additionally differs from the first circulation route in that both of the first circulation pump (high pressure side) 1001 and the first circulation pump (low pressure side) 1002 are arranged at the upstream side of the liquid ejection head and the negative pressure control unit 230 is arranged at the downstream side of the liquid ejection head.

At the second circulation route, the negative pressure control unit 230 operates to confine the pressure fluctuations that arise at the upstream side of itself within a predetermined range that is centered at a preselected and desired pressure level even when the flow rate in the circulation route fluctuates due to a recording duty difference. The upstream side of the negative pressure control unit 230 is the side that is closer to the liquid ejection unit 300 than to the negative pressure control unit 230. As seen from FIG. 3, the pressure at the downstream side of the negative pressure control unit 230 is preferably reduced by means of the second circulation pump 1004 and by way of the liquid supply unit 220. Such an arrangement can raise the degree of freedom of laying out the buffer tank 1003 in the recording apparatus 1000 because the arrangement can suppress the influence of the head pressure of the buffer tank 1003 on the liquid ejection head 3. The second circulation pump 1004 may be replaced by a water header tank that is so arranged as to represent a predetermined water head difference relative to the negative pressure control unit 230.

As illustrated in FIG. 3, the negative pressure control unit 230 has two pressure regulators in which mutually different respective control pressures are preselected and preset as in the instance of the first circulation route. With regard to the two pressure regulators, the pressure regulator (H) with relatively high preselected output pressure and the pressure regulator (L) with relatively low preselected output pressure are connected respectively to the common supply channel 211 and the common collection channel 212 in the liquid ejection unit 300 by way of the inside of the liquid supply unit 220. Due to the provision of the two negative pressure regulators, the pressure in the common supply channel 211 is higher relative to the pressure in the common collection channel 212. For this reason, part of the liquid that flows through the common supply channel 211 then flows from the common supply channel 211 to the common collection channel 212 by way individual supply channels 213, the flow channels in the inside of the recording element boards 10 and the individual collection channels 214 (as indicated by arrows in FIG. 3). As described above, the second circulation route can produce liquid flows in the liquid ejection unit 300 just like the first circulation route and additionally provides advantages that are different from those of the first circulation route as will be described below.

The first one of the advantages is that dusts and other foreign objects produced from the negative pressure control unit 230 can scarcely flow into the liquid ejection head because the negative pressure control unit 230 is arranged at the downstream side of the liquid ejection head 3 in the instance of the second circulation route. The second one of the advantages is that, in the instance of the second circulation route, the maximum value of the flow rate necessary to supply liquid from the buffer tank 1003 to the liquid ejection head 3 is smaller than the comparable flow rate in the instance of the first circulation route. The reason for this will be described below.

When the liquid ejection unit 300 is in a recording standby state and hence it is not ejecting any liquid, liquid needs to be made to flow in the common supply channel 211 and also in the common collection channel 212 in order to reduce the temperature differences among the recording element boards 10 in the liquid ejection unit 300. Assume here that the minimum value of the sum of the flow rate of the liquid flowing in the common supply channel 211 and the flow rate of the liquid flowing in the common collection channel 212 necessary to confine the temperature differences among the recording element boards 10 in the liquid ejection head 3 within a desired temperature range, or the minimum circulation flow rate, is A. Also assume that the ejection flow rate in an all ejection state where the liquid ejection unit 300 ejects ink from all of the ejection ports thereof is F. Then, with the first circulation route (in the instance of FIG. 2), the preselected flow rate of the first circulation pump (high pressure side) 1001 and that of the first circulation pump (low pressure side) 1002 is equal to the minimum circulation flow rate A. Therefore, the liquid supply rate necessary to supply liquid to the liquid ejection head 3 in an all ejection state is equal to A+F. Thus, the maximum value of the necessary supply flow rate at the first circulation channel is equal to A+F.

With the second circulation route (in the instance of FIG. 3), on the other hand, the liquid supply rate necessary to supply liquid to the liquid ejection head 3 in a recording standby state is equal to A and the liquid supply rate necessary to supply liquid to the liquid ejection head 3 in an all ejection state is equal to F. Thus, the sum of the preselected flow rate of the first circulation pump (high pressure side) 1001 and that of the first circulation pump (low pressure side) 1002 is equal to either A or F, which is larger than the other one. Therefore, the maximum value of the necessary supply rate at the second circulation route is equal to either A or F, which is larger than the other one.

Accordingly, when two liquid ejection heads 3 having the same configuration but one of them employs the first circulation route and the other employs the second circulation route, are compared, the maximum value of the necessary supply rate for the liquid ejection head 3 using the second circulation route (A or F) is inevitably smaller than the maximum value of the necessary supply rate using the first circulation route (A+F). Therefore, the degree of freedom of selection of applicable circulation pump at the second circulation route is higher than the comparable value at the first circulation route. In other words, a low cost circulation pump having a simple configuration may be put to use and/or the load of the cooler (not illustrated) to be installed at the main body side route may be reduced to provide an advantage of reducing the cost of the recording apparatus main body. This advantage will be particularly remarkable at a line type liquid ejection head whose A value or F value is relatively large and more particularly remarkable at a line type liquid ejection head having a large longitudinal length.

On the other hand, however, there are instances where the use of the first circulation route is more advantageous than the use of the second circulation route. For example, when the second circulation route is adopted, the flow rate of the liquid flowing in the liquid ejection unit 300 becomes maximum in a recording standby state and hence the lower the recording duty for the image to recorded, the higher the negative pressure applied to the ejection ports. Therefore, particularly when the channel width (the transversal length of the channel in the direction orthogonal to the direction in which liquid flows) of the common supply channel 211 and that of the common collection channel 212 are reduced to reduce the width of the liquid ejection head (the length of the liquid ejection head in the transversal direction), high negative pressure is applied to the ejection ports at the time of recording an image of low recording duty where unevenness of the image tends to become remarkable. Then, the influence of so-called satellite droplets can become significantly large. When, on the other hand, the first circulation route is adopted, high negative pressure is applied to the ejection ports only at the time of recording an image of high recording duty so that, if satellite droplets are produced, they are hardly visible to eyes. Then, the first circulation route provides an advantage that the adverse effect of satellite droplets on the recorded image is minimal.

Thus, a preferable one of the first circulation route and the second circulation route may be selected depending on the specification of the liquid ejection head and that of the recording apparatus main body (including the specified value of the ejection flow rate F, the specified value of the minimum circulation flow rate A and the specified channel resistance value in the liquid ejection head).

(Explanation of the Configuration of the Liquid Ejection Head)

Figure 4A:
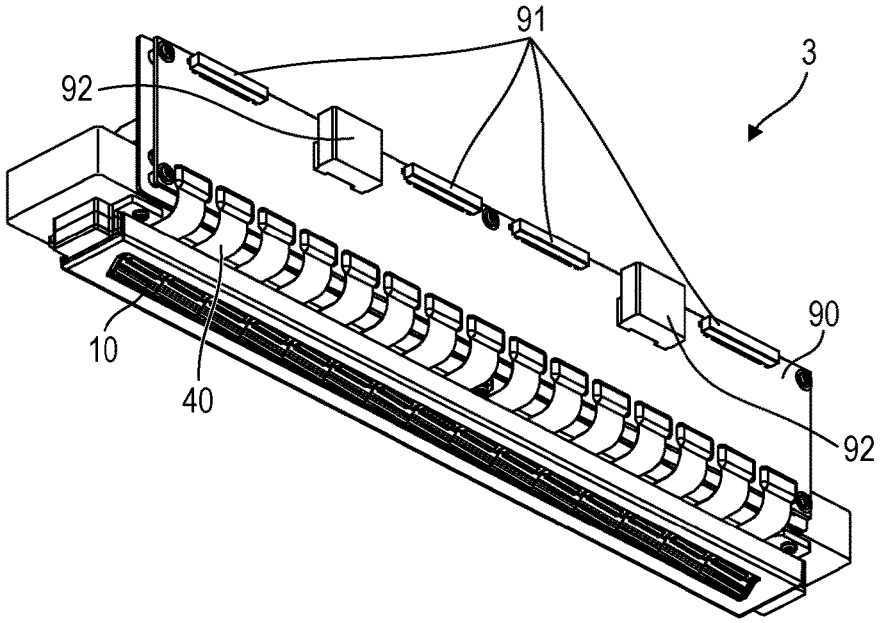
FIGS. 4A and 4B are schematic perspective views of the liquid ejection head of Use Example 1 of the present invention, schematically representing the configuration thereof.
Figure 4B:
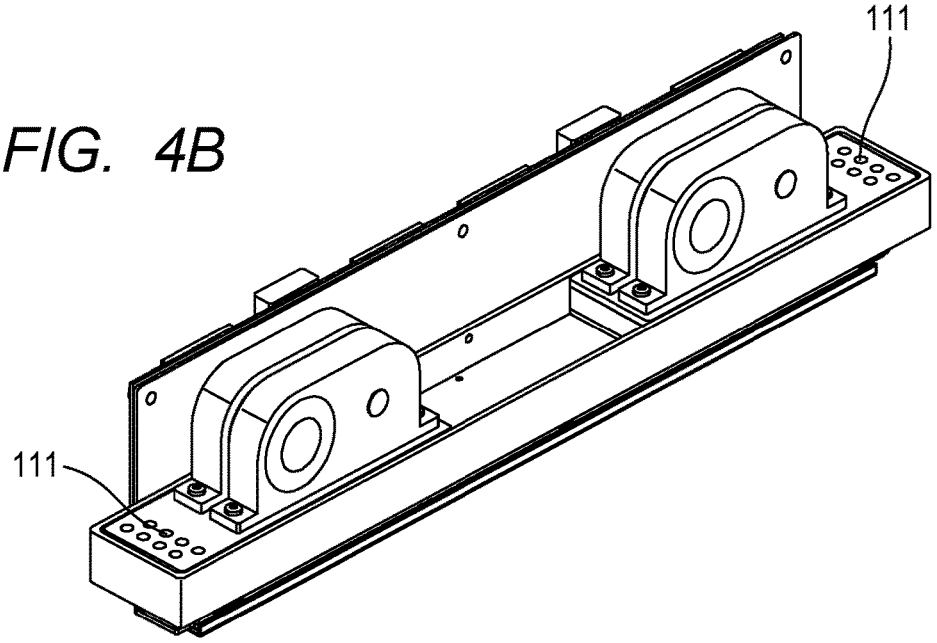

Now, the configuration of the liquid ejection head 3 of Use Example 1 will be described below. FIGS. 4A and 4B are schematic perspective views of the liquid ejection head 3 of this use example. The liquid ejection head 3 is a line type liquid ejection head formed by linearly arranging a total of fifteen (15) recording element boards 10 (in line), each of which is capable of ejecting four color inks of CMYK. As illustrated in FIG. 4A, the liquid ejection head 3 includes recording element boards 10, flexible wiring boards 40, signal input terminals 91 and power supply terminals 92, the signal input terminals 91 and the power supply terminals 92 being electrically connected to the recording element boards 10 and the flexible wiring boards 40 by way of an electrical wiring board 90. The signal input terminals 91 and the power supply terminals 92 are electrically connected to the control unit (not illustrated) of recording apparatus 1000 and respectively supply logic signals and electric power necessary for ejecting liquid to the recording element boards 10. Intensive wiring can be realized by the electric circuits in the electrical wiring board 90 to reduce the number of signal input terminals 91 and that of power supply terminals 92 relative to the number of recording element boards 10. Then, as a result, the number of electric connections that need to be removed and reestablished at the time of installing the liquid ejection head 3 and also at the time of replacing the liquid ejection head 3 can be minimized. As illustrated in FIG. 4B, liquid connection sections 111 located at the opposite edges of the liquid ejection head 3 are connected to the liquid supply system of the recording apparatus 1000. With this arrangement, four color inks of CMYK are supplied from the supply system of the recording apparatus 1000 to the liquid ejection head 3 and the inks that have passed through the inside of the liquid ejection head 3 are collected and brought back to the supply system of the recording apparatus 1000. In this way, each of the four color inks can circulate by way of the respective ink routes in the recording apparatus 1000 and also the respective ink routes in the liquid ejection head 3.

Figure 5:
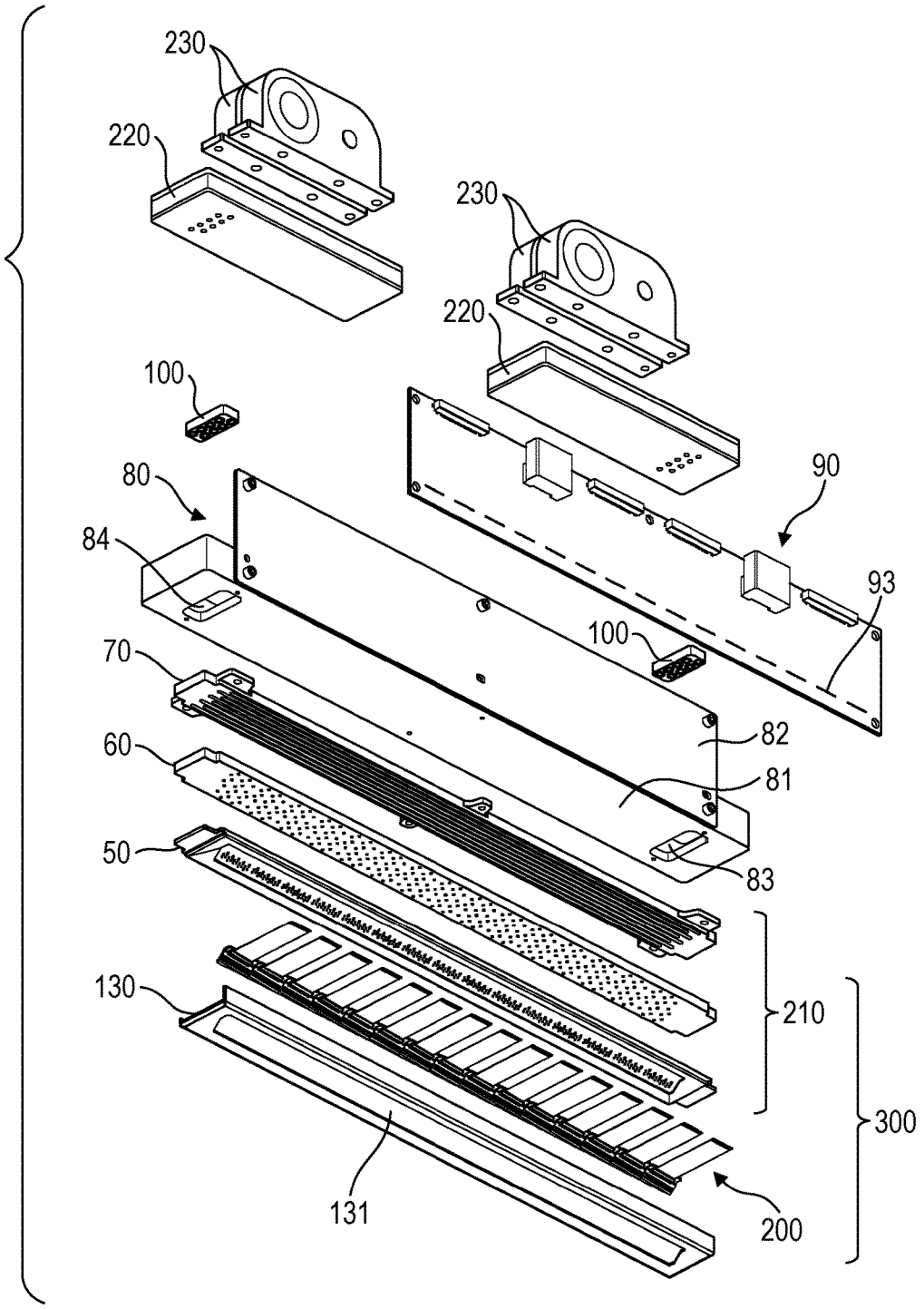
FIG. 5 is an exploded schematic perspective view of the liquid ejection head of Use Example 1 of the present invention.

FIG. 5 is an exploded schematic perspective view of the liquid ejection head 3 of Use Example 1, representing the components and the units thereof. In FIG. 5, liquid ejection unit 300, liquid supply units 220 and electrical wiring board 90 are fitted to cabinet 80. The liquid supply units 220 are provided with respective liquid connection sections 111 (see FIGS. 2 and 3) and filters 221 (see FIGS. 2 and 3) for respective color inks are arranged in the insides of the liquid supply units 220 and held in communication with corresponding openings at the liquid connection sections 111 in order to remove foreign objects contained in the liquids being supplied through them. Each of the two liquid supply units 220 is provided with two filters 221 for two different colors. After passing through the respective filters 221, the liquids are then fed to the negative pressure control units 230 arranged on the liquid supply units 220 so as to correspond to the respective colors. The negative pressure control units 230 are units having pressure regulating valves for the four different colors that are designed to remarkably attenuate changes in the pressure losses in the supply systems (the supply systems arranged at the upstream side of the liquid ejection head 3) of the recording apparatus 1000 that can take place due to fluctuations in the liquid flow rates by means of the valves and the spring members arranged in the inside of the units. Due to this arrangement, changes in the negative pressure at the downstream side of each of the pressure control units (at the side of the liquid ejection unit 300) can be confined within a certain range so as to stabilize the negative pressure. Each of the negative pressure control units 230 of the four colors contains two pressure regulating valves for its own color and different control pressures are respectively set in the two pressure regulating valves as described above by referring to FIG. 2. Of the two pressure regulating valves, the high pressure side one communicates with the common supply channel 211 in the liquid ejection unit 300 by way of the liquid supply unit 220 and the low side one communicates with the common collection channel 212 in the liquid ejection unit 300 by way of the liquid supply unit 220.

The cabinet 80 includes a liquid ejection unit support 81 and an electrical wiring board support 82. Thus, the cabinet 80 supports the liquid ejection unit 300 and the electrical wiring board 90 and secures the rigidity of the liquid ejection head 3. The electrical wiring board support 82 is a member for supporting the electrical wiring board 90, which member is rigidly held to the liquid ejection unit support 81 by means of screws. The liquid ejection unit support 81 takes the role of correcting warps and deformations that may arise to the liquid ejection unit 300 and secures the relative positional accuracy of the plurality of recording element boards 10, thereby suppressing stripes and unevenness that may otherwise appear on the images recorded by the recording apparatus. Therefore, the liquid ejection unit support 81 preferably represents a satisfactory level of rigidity. Materials that can preferably be used for the liquid ejection unit support 81 include metallic materials such as SUS (stainless steel) and aluminum and ceramic materials such as alumina. The liquid ejection unit support 81 is provided with openings 83 and 84 for receiving rubber joints 100. The liquid supplied from the liquid supply units 220 is guided to the third flow channel forming member 70 that the liquid ejection unit 300 includes by way of the rubber joints 100.

The liquid ejection unit 300 includes a plurality of liquid ejection modules 200 and a flow channel forming member 210 and a cover member 130 is fitted to the surface of the liquid ejection unit 300 that faces the recording medium. As illustrated in FIG. 5, the cover member 130 is a member having a surface that appears like a picture frame and an elongated oblong opening 131, through which the recording element boards 10 and seal members 110 (see FIGS. 9A and 9B) that belong to the respective ejection modules 200 are exposed to the outside. The frame surrounding the opening 131 operates as contact surface that contacts the cap member for covering the liquid ejection head 3 in a recording standby state. Therefore, an adhesive agent, a sealing material and a filling material are preferably applied to the liquid ejection unit 300 along the periphery of the opening 131 to flatten the undulations and fill the gaps on the ejection surface of the liquid ejection unit 300 in order to produce a closed space in the liquid ejection head 3 when the liquid ejection head is capped by the cover member 130.

Now, the configuration of the flow channel forming member 210 of the liquid ejection unit 300 will be described below. As illustrated in FIG. 5, the flow channel forming member 210 is formed by sequentially laying first flow channel forming member 50, second flow channel forming member 60 and third flow channel forming member 70 one on the other in the above-mentioned order. The flow channel forming member 210 distributes the liquid supplied from the liquid supply units 220 to the individual ejection modules 200 and returns the liquid flowing back from the ejection modules 200 to the liquid supply units 220. The flow channel forming member 210 is rigidly held to the liquid ejection unit support 81 by means of screws to suppress warps and deformations that may otherwise arise to the flow channel forming member 210.

Figure 6A:
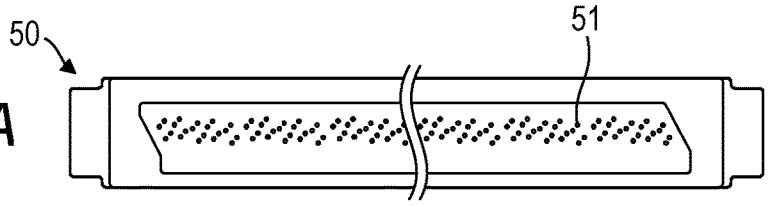
FIGS. 6A, 6B, 6C, 6D, 6E and 6F are surface views of the flow channel forming member in Use Example 1 of the present invention.
Figure 6B:
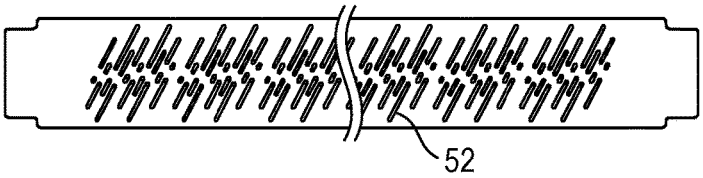
Figure 6C:
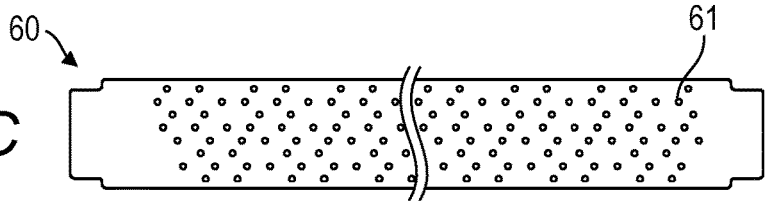
Figure 6D:
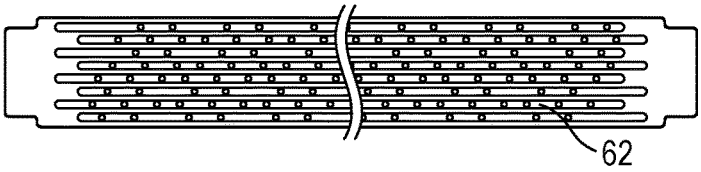
Figure 6E:
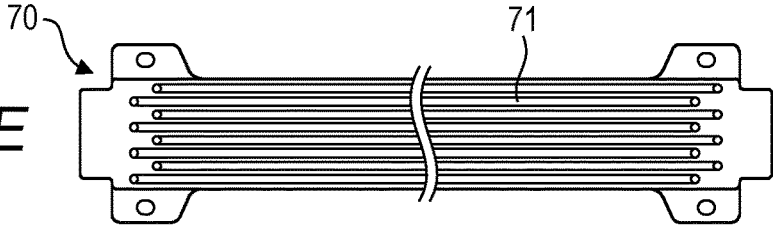
Figure 6F:
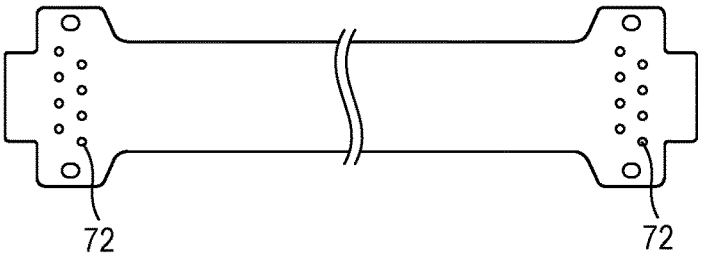

FIGS. 6A through 6F are views representing the front surfaces and rear surfaces of the first through third flow channel forming members. More specifically, FIG. 6A represents the surface of the first flow channel forming member 50 on which the ejection modules 200 are mounted and FIG. 6F represents the surface of the third flow channel forming member 70 that is held in contact with the liquid ejection unit support 81. The first flow channel forming member 50 and the second flow channel forming member 60 are joined together such that the contacting surfaces illustrated in FIGS. 6B and 6C are located vis-à-vis relative to each other, whereas the second flow channel forming member and the third flow channel forming member are joined together such that the contacting surfaces illustrated in FIGS. 6D and 6E are located vis-à-vis relative to each other. As the second flow channel forming member 60 and the third flow channel forming member 70 are joined together, a total of eight (8) common channels that extend in the longitudinal direction of the flow channel forming member are produced by the common channel forming grooves 62 formed on the second flow channel forming member 60 and the common channel forming grooves 71 formed on the third flow channel forming member 70. Then, as a result, a set of a common supply channel 211 and a common collection channel 212 is formed for each of the four colors of CMYK in the inside of the flow channel forming member 210 (see FIG. 7). Communication ports 72 of the third flow channel forming member 70 are held in communication with the respective holes of the rubber joints 100 so as to be fluidically connected to the liquid supply units 220. A plurality of communication ports 61 is formed at the bottom surfaces of the common channel forming grooves 62 of the second flow channel forming member 60 such that each of them communicates with one of the opposite edges of corresponding one of the individual channel forming grooves 52 of the first flow channel forming member 50. A communication port 51 is formed at the other edge of each of the individual channel forming grooves 52 of the first flow channel forming member 50 such that the individual channel forming grooves 52 fluidically communicate with the plurality of ejection modules 200 by way of the communication ports 51. The individual channel forming grooves 52 allow flow channels to be intensively arranged at and near the center of the flow channel forming member.

The first through third flow channel forming members 50, 60 and 70 are preferably formed by using a material that has an anti-corrosion property relative to liquid and also a low linear expansion coefficient. A composite material produced by using, for example, alumina, LCP (liquid crystal polymer), PPS (poly-phenyl sulfide) or PSF (polysulfone) as base material and adding an inorganic filler material is preferably employed for the first through third flow channel forming members 50, 60 and 70. Inorganic filler materials that can be used for this purpose include micro particles and fibers of silica. The flow channel forming member 210 may be formed by sequentially laying the three flow channel forming members one on the other and bonding them by means of an adhesive agent or, when a composite material is selected for it, by bonding the flow channel forming members together by means of welding.

Figure 7:
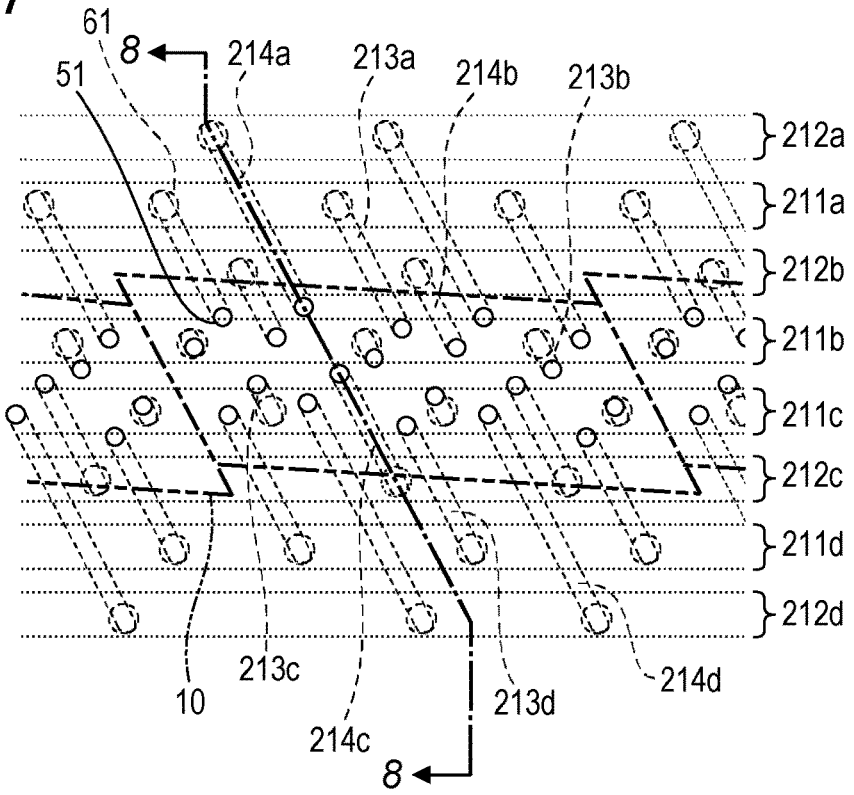
FIG. 7 is an enlarged schematic perspective see-through view of the flow channel forming member of Use Example 1 of the present invention, representing flow channels in the inside.

Now, the connection relationship of the flow channels in the flow channel forming member 210 will be described below by referring to FIG. 7. FIG. 7 is an enlarged schematic perspective see-through view, representing part of the flow channels in the flow channel forming member 210 formed by bonding the first through third flow channel forming members as viewed from the surface of the first flow channel forming member 50 on which ejection modules 200 are to be mounted. Common supply channels 211 (211*a*, 211*b*, 211*c*, 211*d*) and common collection channels 212 (212*a*, 212*b*, 212*c*, 212*d*) that extend in the longitudinal direction of the liquid ejection head 3 for the four colors of CMYK are arranged on the flow channel forming member 210. A plurality of individual supply channels 213 (213*a*, 213*b*, 213*c*, 213*d*) that are formed by individual channel forming grooves 52 is connected respectively to the common supply channels 211 of the four colors by way of the communication ports 61. Similarly, a plurality of individual collection channels 214 (214*a*, 214*b*, 214*c*, 214*d*) that are formed by individual channel forming grooves 52 is connected respectively to the common collection channels 212 of the four colors by way of the communication ports 61. Due to such a channel arrangement, liquid can be made to flow intensively to the recording element boards 10 arranged at a center part of the flow channel forming member from the common supply channels 211 by way of the individual supply channels 213. Additionally, liquid can be collected from the recording element boards 10 to the common collection channels 212 by way of the individual collection channels 214.

Figure 8:
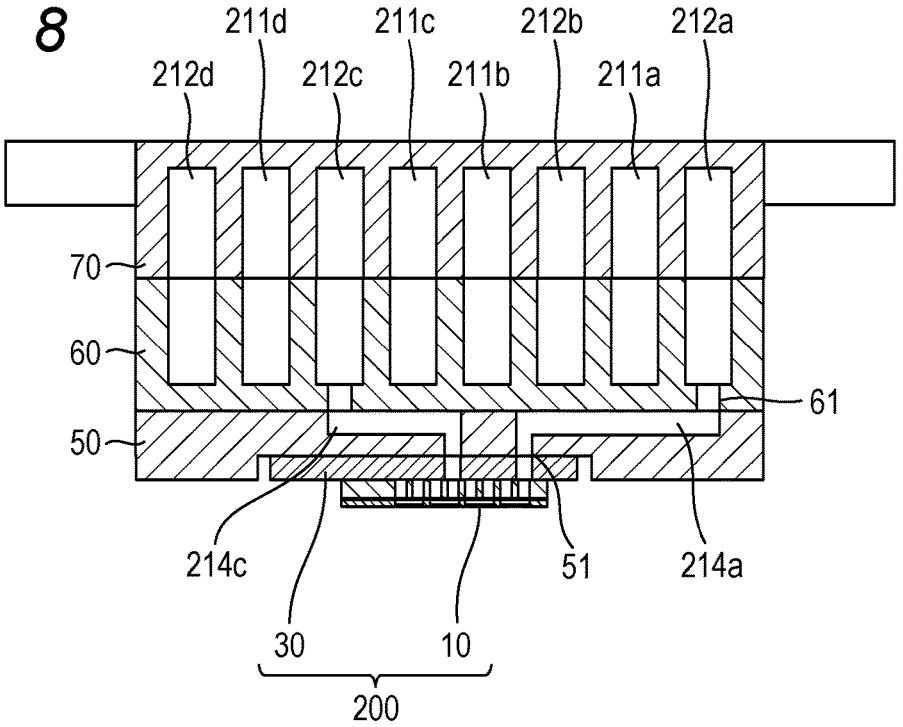
FIG. 8 is a schematic cross-sectional view taken along line 8-8 in FIG. 7.

FIG. 8 is a schematic cross sectional view taken along line 8-8 in FIG. 7. As illustrated in FIG. 8, the individual collection channels 214*a* and 214*c* are respectively held in communication with the ejection modules 200 by way of the communication ports 51. While only the individual collection channels 214*a* and 214*c* are illustrated in FIG. 8, some other cross sectional view will represent that the individual supply channels 213 and the ejection modules 200 are respectively held in communication with each other as seen from FIG. 7. Flow channels are formed in the support member 30 and the recording element board 10 that are contained in each of the ejection modules 200 in order to supply liquid from the first flow channel forming member 50 to the recording elements 15 (see FIG. 10B) arranged on the recording element board 10. Similarly, channels are formed in the support member 30 and the recording element board 10 that are contained in each of the ejection modules 200 in order to collect (flow back) part or all of the liquid supplied to the recording elements 15 down to the first flow channel forming member 50. Note that, for each of the four colors, the common supply channel 211 is connected to the negative pressure control unit 230 (high pressure side) by way of the liquid supply unit 220 and the common collection channel 212 is connected to the negative pressure control unit 230 (low pressure side) by way of the liquid supply unit 220. The negative pressure control unit 230 is designed to produce a pressure difference between the common supply channel 211 and the common collection channel 212. Thus, in the liquid ejection head 3 of this use example where flow channels are connected in a manner as illustrated in FIGS. 7 and 8, a flow of liquid that flows through the route formed by sequentially connecting the common supply channel 211, the individual supply channels 213, the recording element board 10, the individual collection channels 214 and the common collection channel 212 is established for each of the four colors.

(Explanation of the Ejection Modules)

Figure 9A:
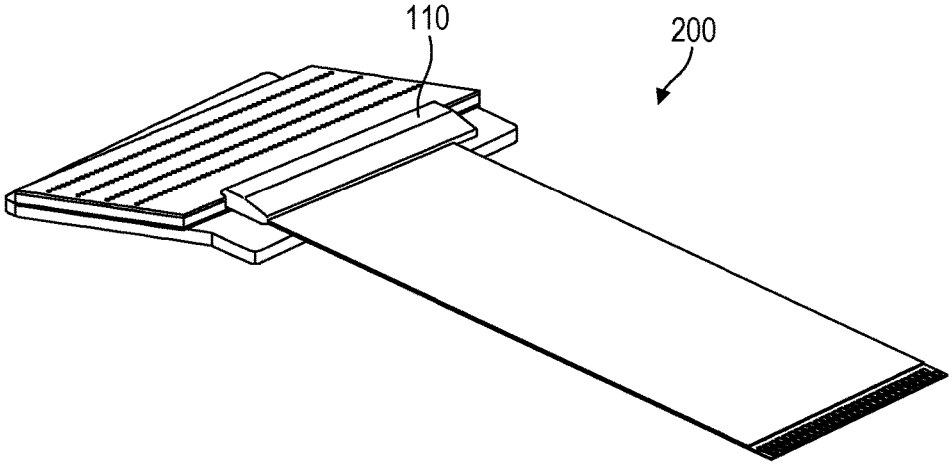
FIGS. 9A and 9B are schematic illustrations of an ejection module in Use Example 1 of the present invention.
Figure 9B:
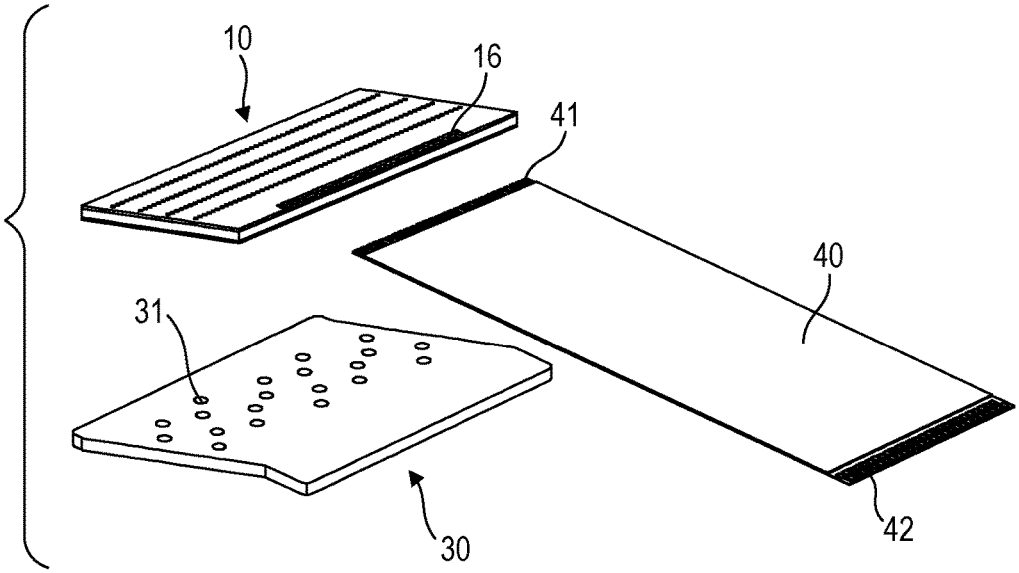

FIG. 9A is a schematic perspective view of one of the ejection modules 200 and FIG. 9B is an exploded perspective view of the ejection module 200. To prepare an ejection module 200, firstly a recording element board 10 and a flexible wiring board 40 are bonded to a support member 30 having liquid communication ports 31 that are formed in advance. Then, the terminals 16 on the recording element board 10 are respectively electrically bonded to the terminals 41 on the flexible wiring board 40 by wire bonding and subsequently the wire bonding section (electrical connection section) is covered and sealed by a seal member 110. The terminals 42 arranged at the side of the flexible wiring board 40 that is opposite to the side thereof located vis-à-vis the recording element board 10 are electrically connected to corresponding one of the connection terminals 93 (see FIG. 5) of the electrical wiring board 90. Support member 30 operates as member for supporting the recording element board 10 and also as flow channel forming member for causing the recording element board 10 and the flow channel forming member 210 to fluidically communicate with each other. Therefore, the support member 30 is preferably prepared so as to represent a high degree of flatness and also to be capable of being highly reliably joined to the recording element board. Examples of preferable materials that can be used to form the support member 30 include alumina and resin materials.

(Explanation of the Structure of the Recording Element Boards)

Figure 10A:
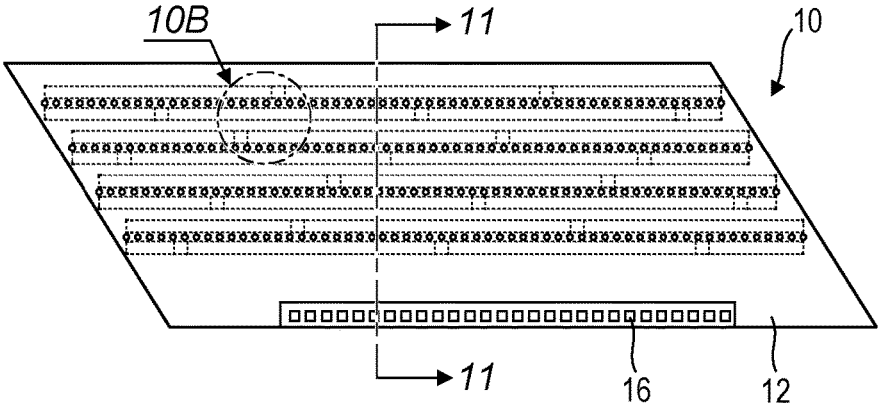
FIGS. 10A, 10B and 10C are schematic plan views of a recording element board in Use Example 1 of the present invention.
Figure 10B:
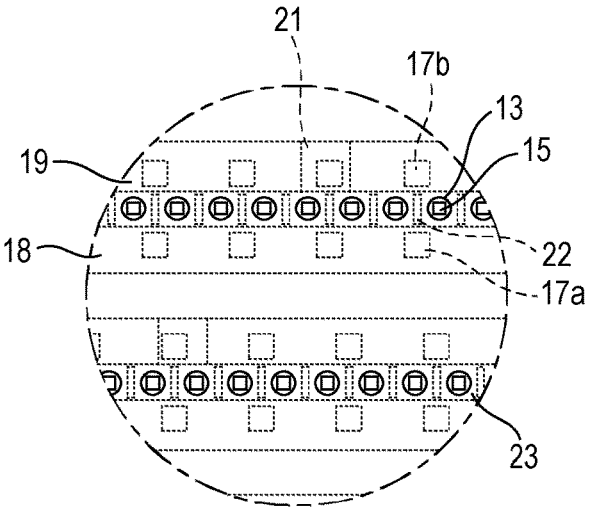
Figure 10C:
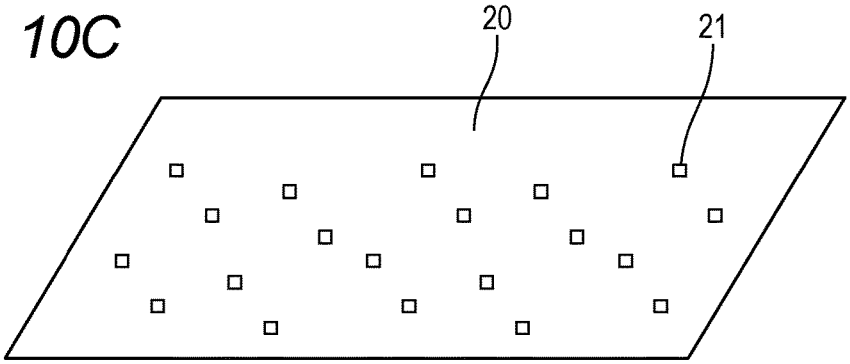

Now, the configuration of the recording element boards 10 in this use example will be described below. FIG. 10A is a schematic plan view of the surface of a recording element board 10 where ejection ports 13 are formed. FIG. 10B is an enlarged view of the part of the recording element board 10 that is surrounded by a circle and indicated by 10B in FIG. 10A. FIG. 10C is a plan view of the surface of the recording element board 10 that is opposite to the surface illustrated in FIG. 10A. As illustrated in FIGS. 10A and 10B, ejection ports are formed in four rows so as to correspond to inks of four colors on ejection port forming member 12 of the recording element board 10. In the following description, the direction in which the rows of ejection ports, each having a plurality of ejection ports 13, extend will be referred to as "ejection port row direction".

As illustrated in FIG. 10B, recording elements 15 are also arranged on the recording element board 10 at positions that correspond to the respective ejection port 13. The recording elements 15 are heat generating elements that generate heat necessary to cause liquid to bubble by thermal energy. For the purpose of the present invention, however, the recording elements 15 may not necessarily be heat generating elements. In other words, the recording elements according to the present invention may be selected from various elements that can generate energy to be utilized to eject liquid such as piezoelectric elements. Pressure chambers 23 that contain respective recording elements 15 in the insides thereof are produced by partition walls 22. The recording elements 15 are electrically connected to the terminals 16 illustrated in FIG. 10A by way of electrical wiring (not illustrated) arranged on the recording element board 10. The recording elements 15 generate heat to boil the liquid in them according to the pulse signals input to them from the control circuit of the recording apparatus 1000 by way of the electrical wiring board 90 (see FIG. 5) and the flexible wiring board 40 (see FIG. 9B) and eject liquid from their ejection ports 13 under the force of the bubbles produced as a result of the boiling. As illustrated in FIG. 10B, a liquid supply channel 18 extends along one of the opposite sides of each of the rows of ejection ports and a liquid collection channel 19 extends along the other side of the row of ejection ports. The liquid supply channels 18 and the liquid collection channels 19 are channels arranged on the recording element board 10 and extend in the extending direction of the rows of ejection ports and each of them is held in communication with the related ones of the ejection ports 13 respectively by way of related ones of either supply ports 17*a* or collection ports 17*b*. The supply ports 17*a* are employed to supply liquid to the pressure chambers 23, whereas the collection ports 17*b* are employed to collect liquid from the pressure chambers 23. The liquid in the pressure chambers 23 is forced to circulate to and from the outside by way of the respective supply ports 17*a* and the respective collection ports 17*b* thereof.

Figure 11:
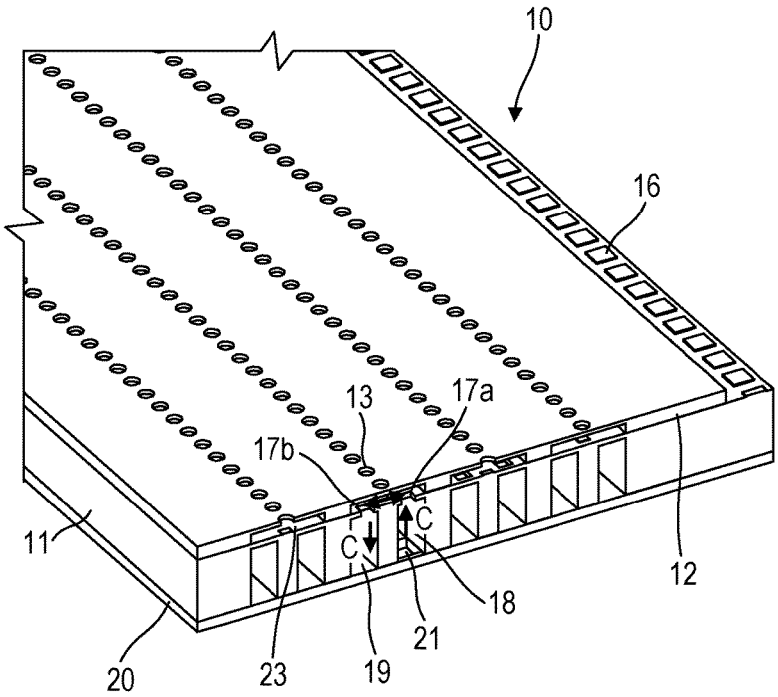
FIG. 11 is a schematic perspective view of the recording element board and the lid member illustrated in cross section taken along line 11-11 in FIG. 10A.

As illustrated in FIG. 10C and also in FIG. 11, which will be described hereinafter, a sheet-like lid member 20 is laid on the back surfaces of the recording element boards 10 that are opposite to the surfaces thereof where ejection ports 13 are formed. The lid member 20 is provided with a plurality of openings 21 that communicate with the liquid supply channels 18 and the liquid collection channels 19 as will be described in greater detail hereinafter. In the instance of this use example, three openings 21 are provided on the lid member 20 for each of the liquid supply channels 18 while two openings 21 are provided on the lid member 20 for each of the liquid collection channels 19. Each of the openings 21 of the lid member 20 illustrated in FIG. 10B is held in communication with a plurality of communication ports 51 illustrated in FIG. 6A. As illustrated in FIG. 11, the lid member 20 also operates as parts of the walls of the liquid supply channels 18 and also parts of the walls of the liquid collection channels 19 that are formed in the substrate 11 of the recording element board 10. The lid member 20 is preferably satisfactorily anti-corrosive relative to liquid and required to represent a high degree of accuracy in terms of shape and positions of the openings 21 from the viewpoint of prevention of undesired mixing of liquids of different colors. For this reason, the lid member 20 is preferably made of a photosensitive resin material or made from a silicon plate and the openings 21 are produced by way of a photolithography process. As seen from the above description, the lid member 20 changes the pitch of the flow channels by means of the openings 21 thereof and hence it desirably has a small thickness from the viewpoint of pressure loss. Therefore, the lid member 20 is preferably formed as a filmy member.

Now, how liquid flows in each of the recording element boards 10 will be described below. FIG. 11 is a schematic perspective view of a recording element board 10 and a lid member illustrated in cross section as taken along line 11-11 in FIG. 10A. The recording element board 10 is formed by laying an ejection port forming member 12 that is made of a photosensitive resin material on a substrate 11 that is made of Si. The lid member 20 is bonded to the back surface of the substrate 11. Recording elements 15 are formed on the front surface of the substrate 11 (see FIG. 10B) and grooves for forming liquid supply channels 18 and liquid collection channels 19, which extend along the rows of ejection ports, are formed on the opposite surface, or the back surface, thereof. The liquid supply channels 18 and the liquid collection channels 19, which are formed by the substrate 11 and the lid member 20, are respectively connected to the common supply channels 211 and the common collection channels 212 in the flow channel forming member 210 and a pressure difference is produced between the liquid supply channels 18 and the liquid collection channels 19. While the liquid ejection head 3 is driven to operate for recording by ejecting liquid from some of the ejection ports 13 thereof, liquid flows at the ejection ports that are not ejecting liquid. Some of the liquid in the liquid supply channel 18 of each of the rows of ejection ports flows to the corresponding liquid collection channel 19 by way of the supply ports 17*a*, the pressure chambers 23 and the collection ports 17*b*. Thus, the liquid, or the ink, in the ejection ports 13 that are not ejecting liquid and also in the related pressure chambers 23 whose viscosity is raised by evaporation, and bubbles and the foreign objects contained in the liquid can be collected to the liquid collection channels 19 by the flow (indicated by arrows C in FIG. 11). The liquid flow can also suppress the increase in the viscosity of the liquid, or the ink, held in those ejection ports 19 and those pressure chambers 23. The liquid collected to the liquid collection channels 19 is then collected by way of the openings 21 of the lid member 20 and the liquid communication ports 31 of the support members 30 (see FIG. 9B) sequentially to the communication ports 51 in the flow channel forming members 210, the individual collection channels 214 and the common collection channels 212. Then, ultimately the liquid is collected to the supply route of the recording apparatus 1000.

Differently stated, the liquid supplied from the recording apparatus 1000 main body to the liquid ejection head 3 flows so as to supply and to be collected in a manner as described below. The liquid firstly flows from the liquid connection sections 111 of the liquid supply units 220 into the inside of the liquid ejection head 3. Then, the liquid is sequentially fed to the rubber joints 100, the communication ports 72 and the common channel forming grooves 71 formed in the third flow channel forming member, the common channel forming grooves 62 and the communication ports 61 formed in the second flow channel forming member 22 and the individual channel forming grooves 52 and the communication ports 51 formed in the first flow channel forming member. Thereafter, the liquid is supplied to the pressure chambers 23 sequentially by way of the liquid communication ports 31 formed in the support members 30, the openings 21 formed in the lid members and the liquid supply channels 18 and the supply ports 17*a* formed in the substrate 11. Of the liquid supplied to the pressure chambers 23, the part that is not ejected from ejection ports 13 flows sequentially through the collection ports 17*b* and the liquid collection channels 19 formed in the substrate 11, the openings 21 formed in the lid members and the liquid communication ports 31 formed in the support members 30. Furthermore, the part of the liquid sequentially flows through the communication ports 51 and the individual channel forming grooves 52 formed in the first flow channel forming member, the communication ports 61 and the common channel forming grooves 62 formed in the second flow channel forming member, the common channel forming grooves 71 and the communication ports 72 formed in the third flow channel forming member 70 and the rubber joints 100. Thereafter, the part of the liquid flows out from the liquid connection sections 111 arranged in the liquid supply units to the outside of the liquid ejection head 3. In the instance of the first circulation route illustrated in FIG. 2, the liquid that flows into it from the liquid connection sections 111 is fed to the rubber joints 100 after passing through the negative pressure control unit 230. In the instance of the second circulation route illustrated in FIG. 3, the liquid collected from pressure chambers 23 flows out to the outside of the liquid ejection head from the liquid connection sections 111 by way of the negative pressure control units 230 after passing through the rubber joints 100.

Additionally, as illustrated in FIGS. 2 and 3, all the liquid that flows in from one of the opposite edges of the communication supply channel 211 of the liquid ejection unit 300 is not necessarily supplied to the pressure chambers 23 by way of the individual supply channels 213. In other words, part of the liquid may flow into the liquid supply unit 220 by way of the other edge of the communication supply channel 211 without flowing into the individual supply channels 213. As a result of providing flow channels through which liquid flows without passing through any recording element board 10, any back flow of the circulating liquid can be suppressed even though the recording element boards 10 are made to possess fine channels that represent a large resistance against flowing liquid as in the case of this use example. Thus, the liquid ejection head 3 of this use example can suppress the phenomenon of uneven ejections and non-ejections and hence can record high quality images because any increase of liquid viscosity can be suppressed at and near the ejection ports 13 and the pressure chambers 23.

(Explanation of the Positional Relationship Among the Recording Element Boards)

Figure 12:
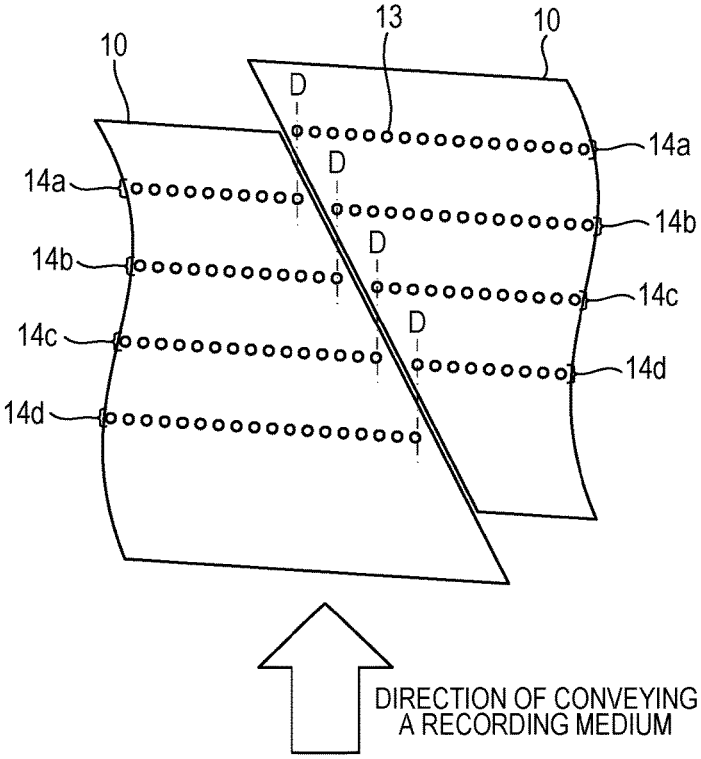
FIG. 12 is an enlarged schematic plan view of a neighboring area of two recording element boards of Use Example 1 of the present invention.

FIG. 12 is an enlarged schematic plan view of a neighboring area of the recording element boards 10 of two adjacently located ejection modules of Use Example 1 of the present invention. Substantially parallelogrammic recording element boards 10 as illustrated in FIGS. 10A through 10C are employed in this use example. As illustrated in FIG. 12, the rows of ejection ports 14*a* through 14*d* of each of the recording element boards 10 are arranged such that they are inclined by a certain angle relative to the direction in which recording mediums are conveyed. As a result of this arrangement, at least one of the ejection ports of each row of ejection ports 13 of a recording element board 10 overlaps one of the ejection ports of the adjacently arranged recording element board 10 in a neighboring area of them as viewed in the direction in which recording mediums are conveyed. In FIG. 12, two ejection ports overlap each other on each of the lines D. With this arrangement, even when one of the recording element boards 10 is displaced from its proper position to some extent, the overlapping ejection ports can be driven to operate in a controlled manner and compensate the displacement so as to make black strips and a blank area shining phenomenon, if any, minimally noticeable. The plurality of recording element boards 10 may be arranged not in a zigzag manner but linearly (inline). Even with the latter arrangement, due to the effect as described above by referring to FIG. 12, black strips and a blank area shining phenomenon can be minimized in recording element board connecting areas, while suppressing any increase of the length of the liquid ejection head 3 as viewed in the recording medium conveying direction. While the recording element boards 10 of this use example are parallelogrammic in plan view, the present invention is by no means limited to the use of paralleogrammic recording element boards and the principle of the present invention is advantageously applicable to instances where, for example, recording element boards 10 that are rectangular, trapezoidal or of some other shape are employed for a liquid ejection head according to the present invention.

(Use Example 2)

Now, the configuration of the recording apparatus 1000 and that of the liquid ejection head 3 of Use Example 2 of the present invention will be described below. Note that Use Example 2 will be described below mainly in terms of differences between Use Example 1 and this example and the explanation of the parts of the configurations of this example that are similar to those of the configurations of Use Example 1 may be omitted.

(Explanation of the Inkjet Recording Apparatus)

Figure 19A:
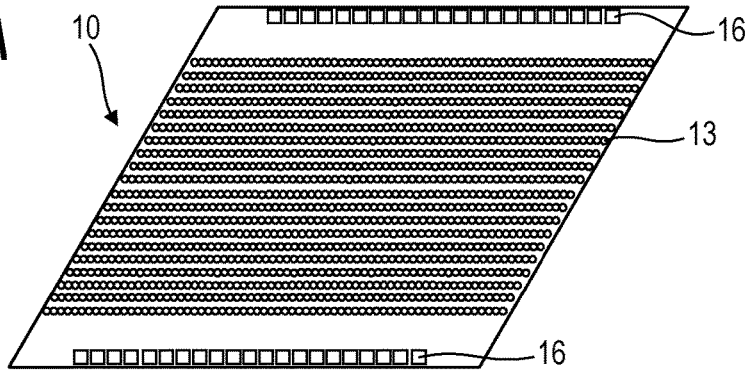
FIGS. 19A, 19B and 19C are schematic plan views of a recording element board in Use Example 2 of the present invention.
Figure 20:
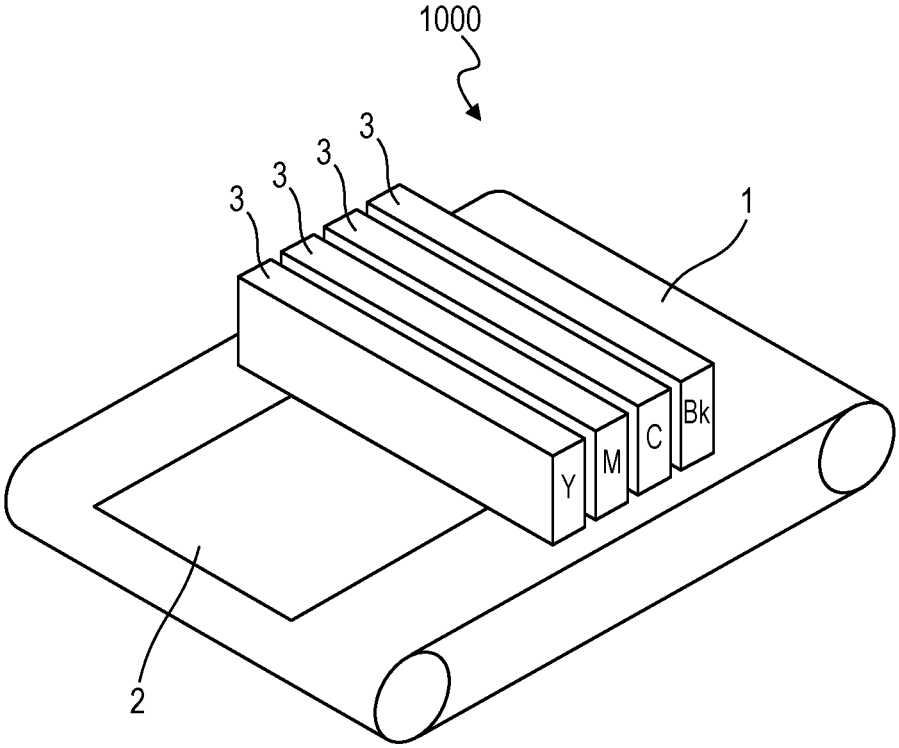
FIG. 20 is a schematic perspective view of the liquid ejection device of Use Example 2 of the present invention, schematically illustrating the configuration thereof.

FIG. 20 is a schematic perspective view of the inkjet recording apparatus of Use Example 2 of the present invention, schematically representing the configuration thereof. The recording apparatus 1000 of Use Example 2 differs from that of Use Example 1 in that a total of four (4) liquid ejection heads 3, which are designed for monochromatic recording so as to correspond to inks of CMYK, are arranged side by side for the purpose of full color recording operations using recording mediums 2. While only a single row of ejection ports is available for each color in Use Example 1, a total of twenty (20) rows of ejection ports are available for each color in Use Example 2 (FIG. 19A). This arrangement allows very high speed recording operations to be executed as the recording data input to the recording apparatus can appropriately be allocated to the plurality of rows of ejection ports. Additionally, if there are ejection ports that have become no longer capable of ejecting liquid in some of the rows of ejection ports, the ejection ports of other rows that are located at corresponding positions relative to the former ejection ports as viewed in the recording medium conveying direction are driven to complementarily eject liquid to secure the reliability of the recording apparatus 1000. Therefore, this recording apparatus 1000 can suitably be used for commercial printing purposes. As in Use Example 1, the supply systems of the recording apparatus 1000, the buffer tanks 1003 and the main tanks 1006 (see FIG. 2) are fluidically connected to the respective liquid ejection heads 3 in this use example. Electrical control units for transmitting electric power and ejection control signals to the liquid ejection heads 3 are electrically connected to the respective liquid ejection heads 3.

(Explanation of the Circulation Routes)

Either the first circulation route illustrated in FIG. 2 or the second circulation route illustrated in FIG. 3 may be used for the liquid circulation route between the recording apparatus 1000 and the liquid ejection heads 3 of this use example as in Use Example 1.

(Explanation of the Configuration of the Liquid Ejection Heads)

Figure 13A:
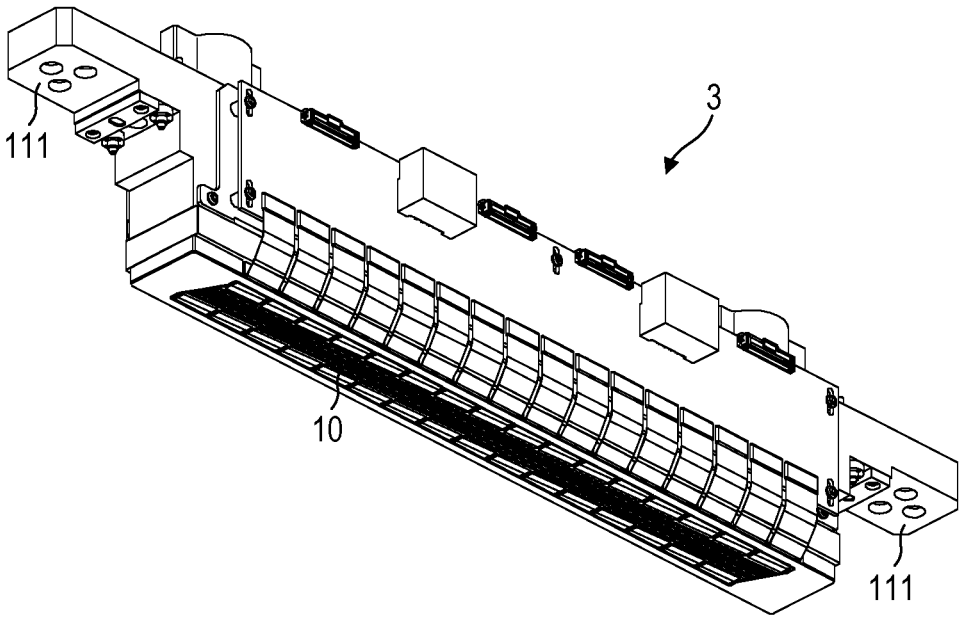
FIGS. 13A and 13B are schematic perspective views of the liquid ejection head of Use Example 2 of the present invention, schematically representing the configuration thereof.
Figure 13B:
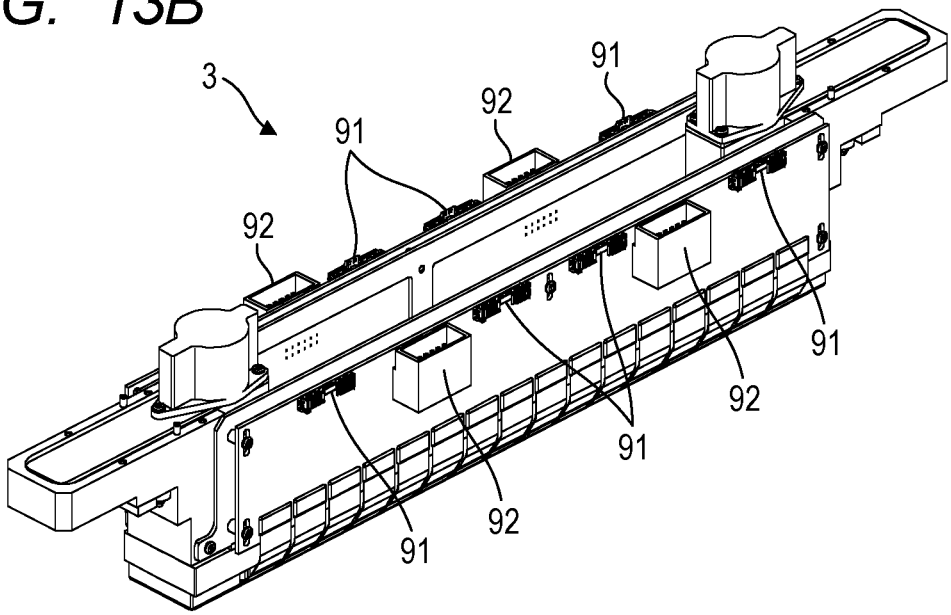

Now, the configuration of the liquid ejection heads 3, which are same with each other, of Use Example 2 of the present invention will be described below. FIGS. 13A and 13B are schematic perspective views of one the liquid ejection heads of Use Example 2 of the present invention, schematically representing the configuration thereof. The liquid ejection head 3 includes a total of sixteen (16) recording element boards 10 linearly arranged side by side in the longitudinal direction of the liquid ejection heed 3. The liquid ejection head 3 is a line type inkjet recording head that can be driven for monochromatic recording using ink of a single color. As in Use Example 1, the liquid ejection head 3 includes liquid connection sections 111, signal input terminals 91 and power supply terminals 92. Since the liquid ejection head 3 of this use example has a large number of rows of ejection ports if compared with Use Example 1, signal input terminals 91 and power supply terminals 92 are arranged along the opposite edges of the liquid ejection head 3. This is to reduce voltage falls and signal transmission delays that can take place in the wiring sections arranged on the recording element boards 10.

Figure 14:
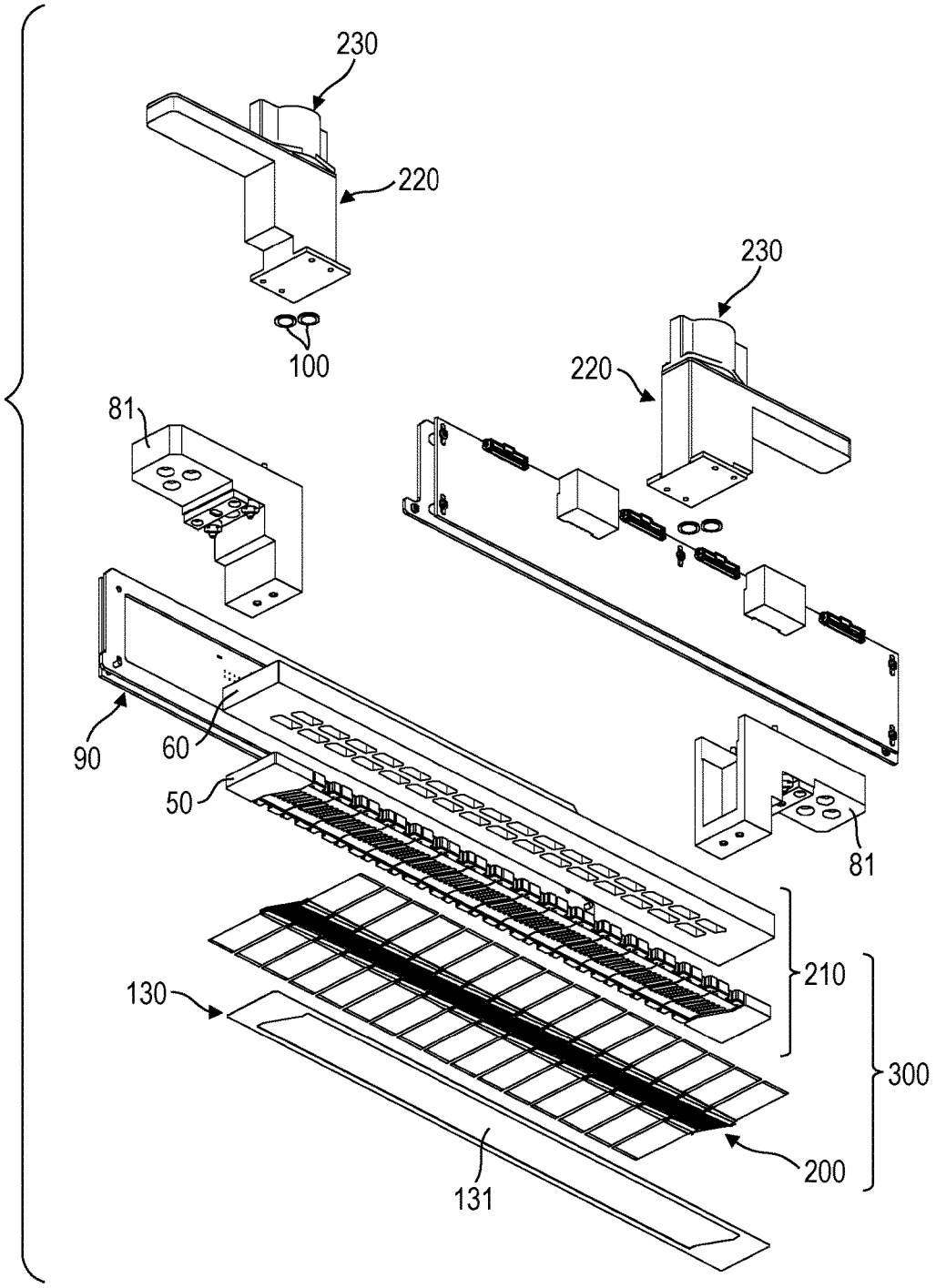
FIG. 14 is an exploded schematic perspective view of the liquid ejection head of Use Example 2 of the present invention.

FIG. 14 is an exploded schematic perspective view of the liquid ejection head of Use Example 2 of the present invention. The parts and the units of the liquid ejection head 3 are individually illustrated in FIG. 14 to illustrate their respective functions. The role of each of the units and the members and the sequence of arrangement of the units and the members from the viewpoint of liquid flow are basically the same as those of Use Example 1 but the functions thereof for securing the rigidity of the liquid ejection head differs from those of Use Example 1. In Use Example 1, the rigidity of the liquid ejection head is secured mainly by the liquid ejection unit support 81. In Use Example 2, on the other hand, the rigidity of the liquid ejection head is secured by the second flow channel forming member 60 included in the liquid ejection unit 300. The liquid ejection unit supports 81 of this use example are respectively connected to the opposite edges of the second flow channel forming member 60 and the liquid ejection unit 300 is mechanically bonded to the carriage of the recording apparatus 1000 to properly place the liquid ejection head 3 in position. Liquid ejection units 220 that include respective negative pressure control units 230 and electrical wiring board 90 are bonded to the liquid ejection unit supports 81. Filters (not illustrated) are contained respectively in the two liquid supply units 220. The two negative pressure control units 230 are so designed as to control pressure by means of their respective negative pressures that differ from each other and one of which is higher than the other. Additionally, when the high pressure side negative pressure control unit 230 and the low pressure side negative pressure control unit 230 are arranged at the opposite edges of the liquid ejection head 3 as illustrated in FIG. 14, the liquid in the common supply channels 211 and the liquid in the common collection channels 212 extending in the longitudinal direction of the liquid ejection head 3 flow in mutually opposite directions. With this arrangement, heat exchanges between the common supply channels 211 and the common collection channels 212 are facilitated to reduce the temperature difference between the two sets of common channels. For this reason, temperature differences can scarcely occur among the plurality of recording element boards 10 arranged along the common channels to provide an advantage that uneven recordings attributable to temperature differences can hardly take place.

Now, the flow channel forming member 210 of the liquid ejection unit 300 will be described below in detail. As illustrated in FIG. 14, the flow channel forming member 210 is formed by laying second flow channel forming member 60 on first flow channel forming member 50 and operates to distribute the liquid fed from the liquid supply units 220 to ejection modules 200. The flow channel forming member 210 also operates as flow channel forming member for returning the liquid flowing back from the ejection modules 200 to the liquid supply units 220. The second flow channel forming member 60 of the flow channel forming member 210 is a member in which common supply channels 211 and common collection channels 212 are formed and, at the same time, takes a role of mainly securing the rigidity of the liquid ejection head 3. For this reason, the second flow channel forming member 60 is preferably formed by using a material that is satisfactorily anti-corrosive relative to liquid and has a high degree of mechanical strength. More specifically, materials that can suitably be used for the second flow channel forming member 60 include SUS, Ti and alumina.

Figure 15A:
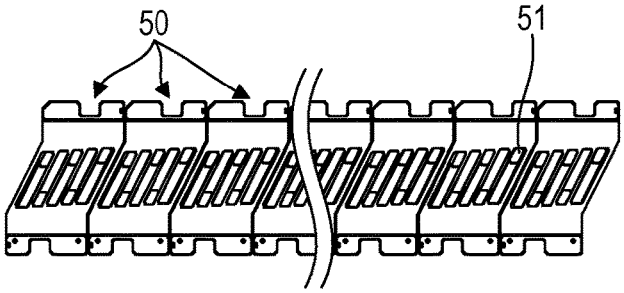
FIGS. 15A, 15B, 15C, 15D and 15E are surface views of the flow channel forming member in Use Example 2 of the present invention.
Figure 15B:
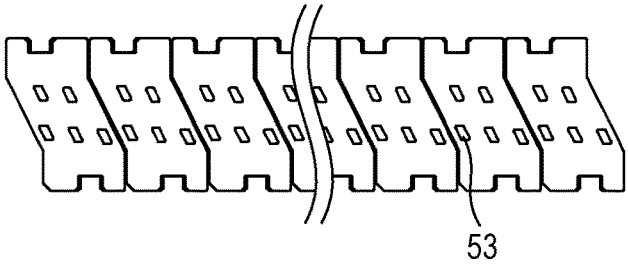
Figure 15C:
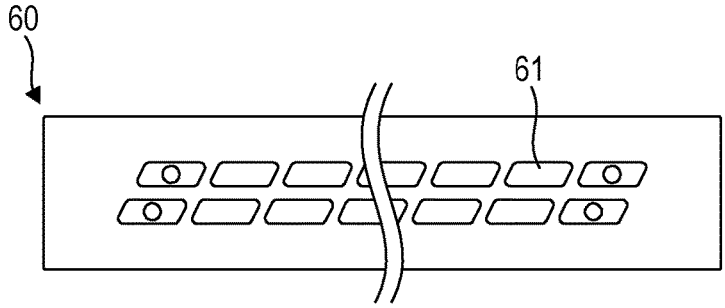
Figure 15D:
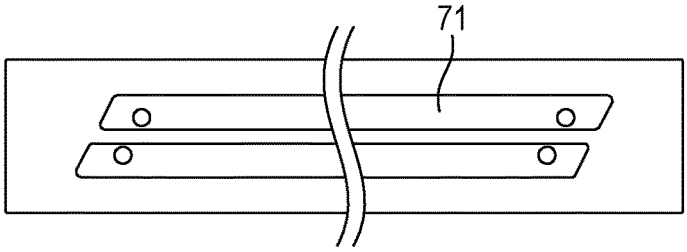
Figure 15E:
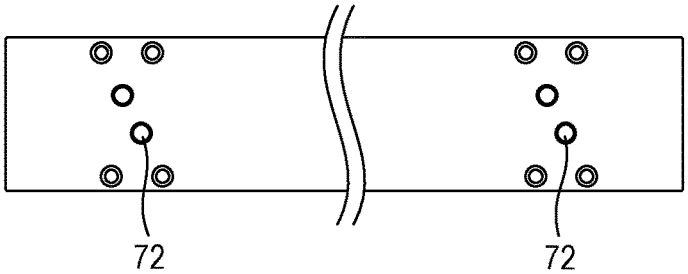

FIG. 15A represents the surface of the first flow channel forming member 50 on which the ejection modules 200 are to be mounted and FIG. 15B represents the opposite side surface thereof that is to be brought into contact with the second flow channel forming member 60. Unlike Use Example 1, the first flow channel forming member 50 of Use Example 2 is formed by arranging a plurality of component members side by side to correspond to the ejection modules 200. When the first flow channel forming member 50 is formed by using a plurality of component members as described above, the length of the first flow channel forming member 50 can be made to correspond to that of the liquid ejection head. Therefore, the arrangement of this first flow channel forming member 50 is particularly suitable for a relatively large scale liquid ejection head 3 that can accommodate itself to B2 size and larger recording mediums. As illustrated in FIG. 15A, the communication ports 51 of the first flow channel forming member 50 fluidically communicate with the ejection modules 200 and, as illustrated in FIG. 15B, the individual communication ports 53 of the first flow channel forming member 50 fluidically communicate with the communication ports 61 of the second flow channel forming member 60. FIG. 15C represents the surface of the second flow channel forming member 60 that is to be brought into contact with the first flow channel forming member 50 and FIG. 15D represents a cross section of a central part of the second flow channel forming member 60 as viewed in the thickness direction thereof, while FIG. 15E represents the surface of the second flow channel forming member 60 that is to be brought into contact with the liquid supply units 220. The functions of the flow channels and the communication ports of the second flow channel forming member 60 are similar to those of the flow channels and the communication ports of Use Example 1 for a single color. One of the pair of common channel forming grooves 71 of the second flow channel forming member 60 is a common supply channel 211 and the other is a common collection channel 212 illustrated in FIG. 16. Each of them runs in the longitudinal direction of the liquid ejection head 3 such that liquid is fed from one of the opposite edges to the other edge. Unlike Use Example 1, the flow direction of the common supply channel 211 and that of the common collection channel 212 are opposite relative to each other in this use example.

Figure 16:
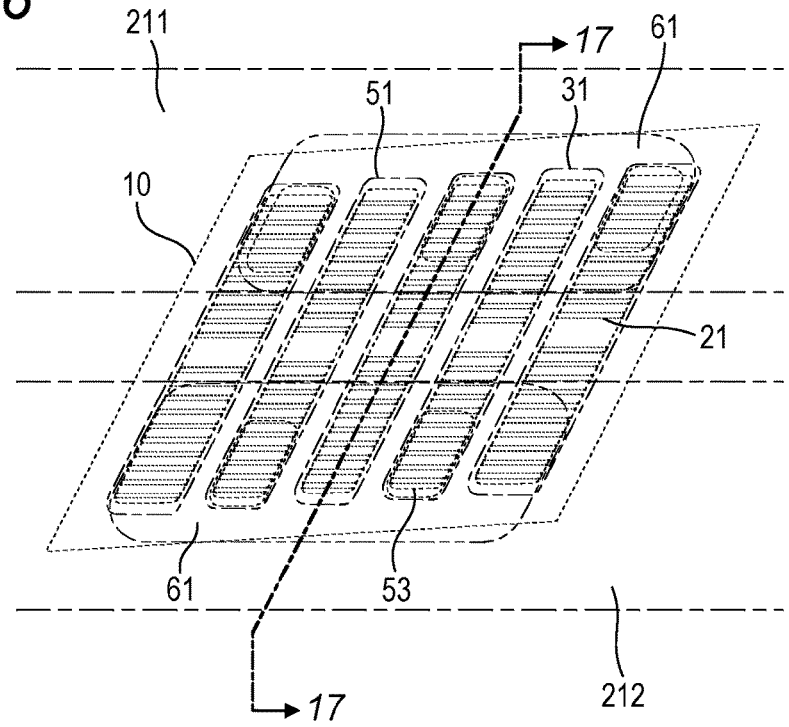
FIG. 16 is a schematic perspective see-through view of a recording element board and a flow channel forming member of Use Example 2 of the present invention, representing the connection relationship thereof from the viewpoint of liquid flowing through them.

FIG. 16 is a schematic perspective see-through view of a recording embodiment board 10 and the flow channel forming member 210 of this use example, representing the connection relationship thereof from the viewpoint of liquid flowing there. As illustrated in FIG. 16, a common supply channel 211 and a common collection channel 212 are arranged in the flow channel forming member 210 so as to extend in the longitudinal direction of the liquid ejection head 3. The communication ports 61 of the second flow channel forming member 60 are aligned with and connected to the respective individual communication ports 53 of the first flow channel forming member 50 to establish liquid supply routes from the communication ports 72 of the second flow channel forming member 60 to the communication ports 51 of the first flow channel forming member 50 by way of the common supply channel 211. Similarly, liquid supply routes are established from the communication ports 72 of the second flow channel forming member 60 to the communication ports 51 of the first flow channel forming member 50 by way of the common collection channel 212.

Figure 17:
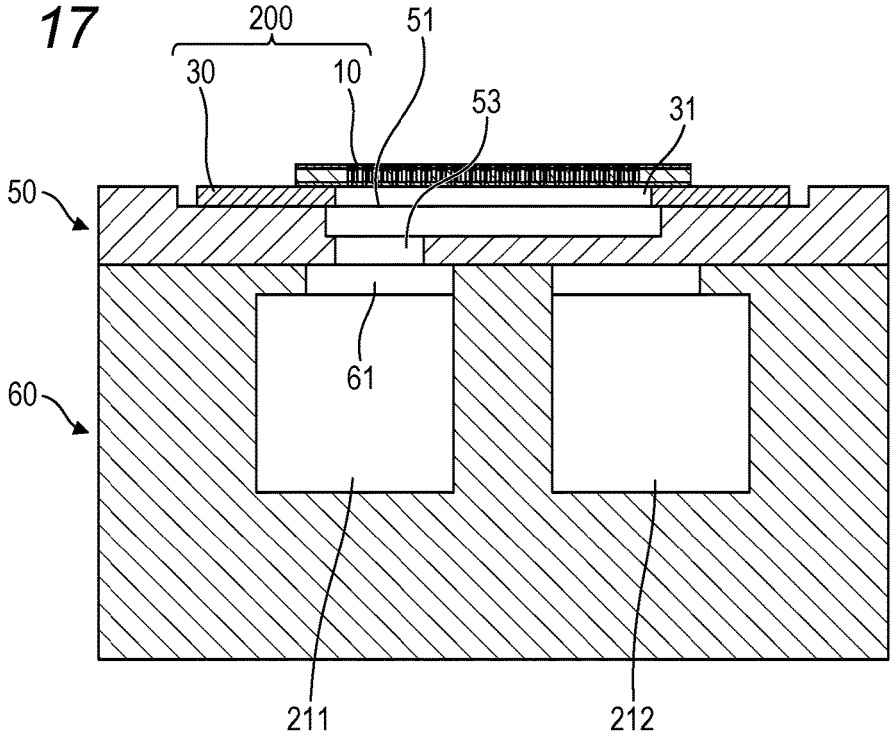
FIG. 17 is a schematic cross-sectional view taken along line 17-17 in FIG. 16.

FIG. 17 is a schematic cross sectional view taken along line 17-17 in FIG. 16. As illustrated in FIG. 17, common supply channel is linked to the ejection modules 200 by way of an individual communication port 53 and a communication port 51. While not-illustrated in FIG. 17, it will be clear by seeing FIG. 16 that individual collection channels are linked to the ejection modules 200 by way of similar routes as will be represented in some other cross section. As in Use Example 1, the ejection modules 200 and the recording element boards 10 are provided with flow channels that communicate with the respective ejection ports 13 such that part or all of the supplied liquid can flow back, passing through the ejection ports 13 (the pressure chambers 23) whose liquid ejecting operations are suspended. Additionally, as in Use Example 1, the common supply channels 211 are connected to the negative pressure control unit 230 (high pressure side) by way of related one of the liquid supply units 220, while the common collection channels 212 are connected to the negative pressure control unit 230 (low pressure side) by way of the other liquid supply unit 220. Due to this arrangement that gives rise to a pressure difference between the common supply channels 211 and the common collection channels 212, a liquid flow takes place from the common supply channels 211 to the common collection channels 212 by way of the ejection ports 13 (pressure chambers 23) of the recording element boards 10.

(Explanation of the Ejection Modules)

Figure 18A:
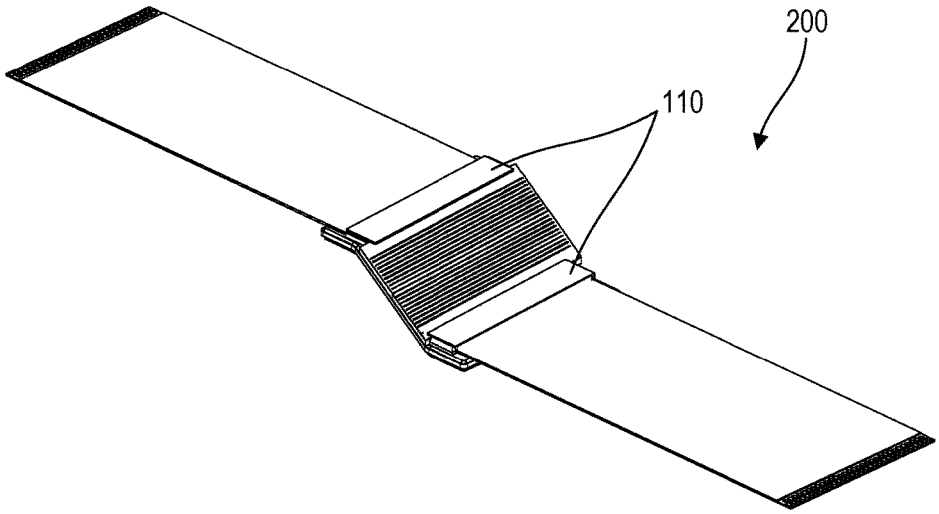
FIGS. 18A and 18B are schematic illustrations of an ejection module in Use Example 2 of the present invention.
Figure 18B:
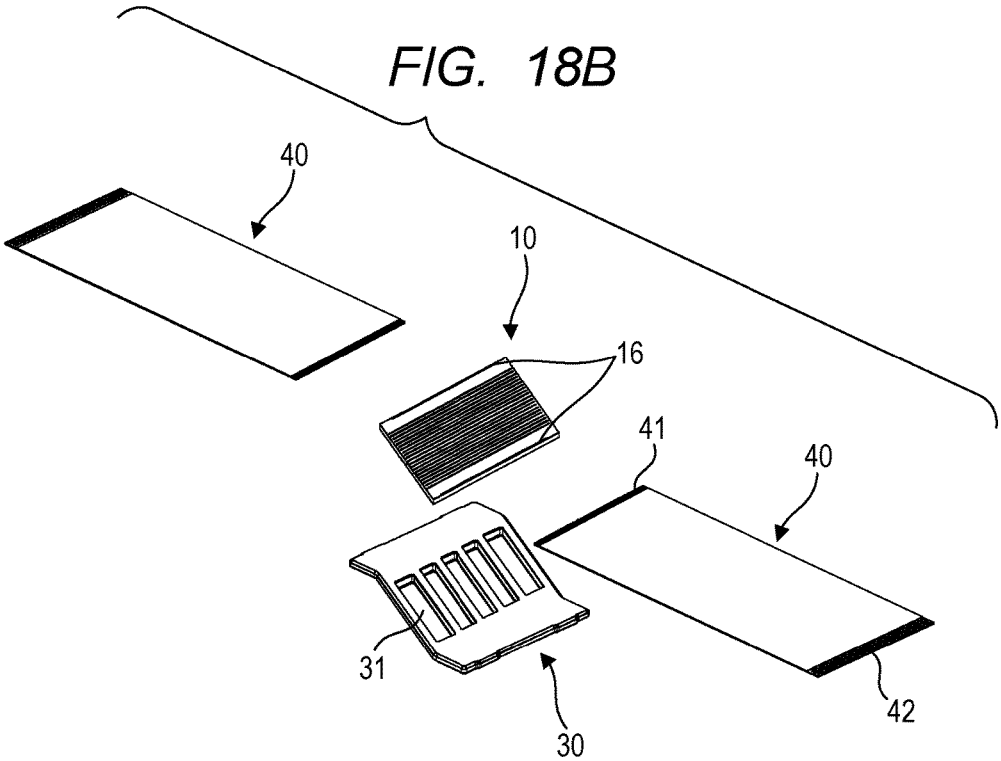

FIG. 18A is a schematic perspective view of an ejection module 200 and FIG. 18B is an exploded perspective view of the ejection module. The difference between an ejection module in Use Example 1 and this ejection module lies in that a plurality of terminals 16 are arranged along the opposite edges running in the direction of the plurality of rows of ejection ports of the recording element board 10 (each long side portion of the recording element board 10)

and that a pair of flexible wiring boards 40 that are electrically connected to these terminals 16 are provided for a single recording element board 10. This arrangement is introduced here because a total of twenty (20) rows of ejection ports are arranged in the recording element board 10, representing a significant increase of rows of ejection ports from the eight (8) rows of ejection ports in Use Example 1. In other words, this arrangement is introduced in order to reduce the maximum distance from the terminals 16 to the recording elements 15 that are arranged to correspond to the rows of ejection ports, thereby reducing voltage falls and signal transmission delays that may occur at the wiring section of the recording element board 10. Additionally, the liquid communication ports 31 of the support member 30 are arranged in the recording element board 10 so as to extend across all the rows of ejection ports. Otherwise, the ejection modules are similar to those of Use Example 1.

(Explanation of the configuration of the recording element boards)

Figure 19B:
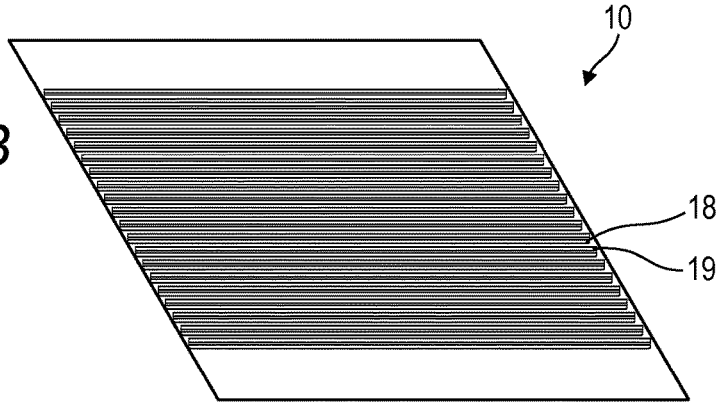
Figure 19C:
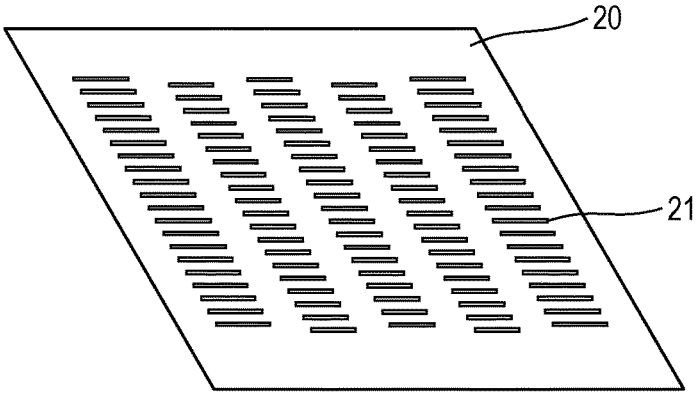

FIG. 19A is a schematic view of the surface of one of the recording element boards 10 where ejection ports 13 are arranged. FIG. 19C is a schematic view of the surface (rear surface) opposite to the one illustrated in FIG. 19A. FIG. 19B is a schematic view of the surface (rear surface) of the recording element board 10 same as that of FIG. 19C from which the lid member 20 is removed. As illustrated in FIG. 19B, liquid supply channels 18 and liquid collection channels 19 are alternately arranged on the rear surface of the recording element board 10 so as to extend in the direction of the rows of ejection ports. While a significantly large number of rows of ejection ports are arranged if compared with Use Example 1, the intrinsic difference between Use Example 1 and this use example lies in that terminals 16 are arranged along the opposite edges of the recording element board 10 that run in the direction of the rows of ejection ports as described above. The basic configuration of this use example including that each of the rows of ejection ports is provided with a pair of a liquid supply channel 18 and a liquid collection channel 19 and that the lid member 20 is provided with openings 21 that communicate with the liquid communication ports 31 of the support member 30 is similar to that of Use Example 1.

Now, embodiments of the present invention will be described below in terms of characteristic aspects thereof.

(First Embodiment)

Figure 21A:
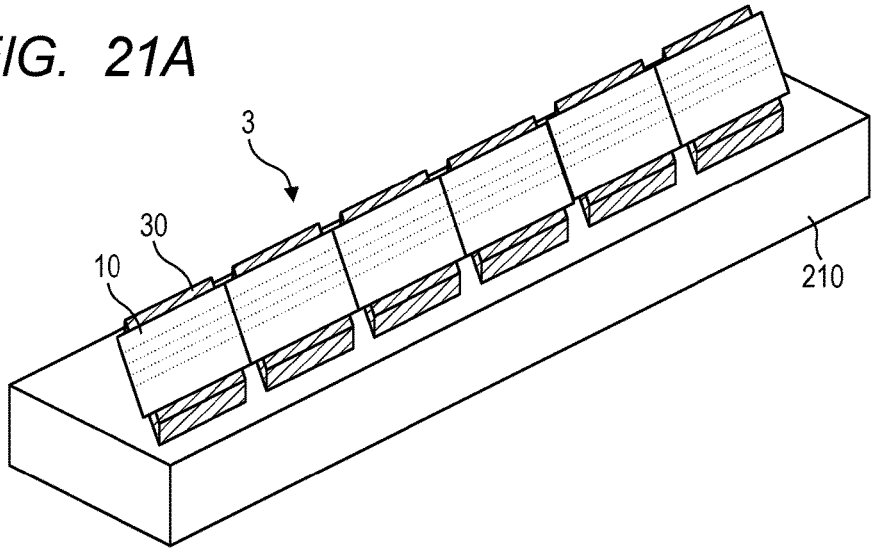
FIGS. 21A and 21B are schematic perspective views of the liquid ejection head according to the first embodiment of the present invention, schematically illustrating the configuration thereof.
Figure 21B:
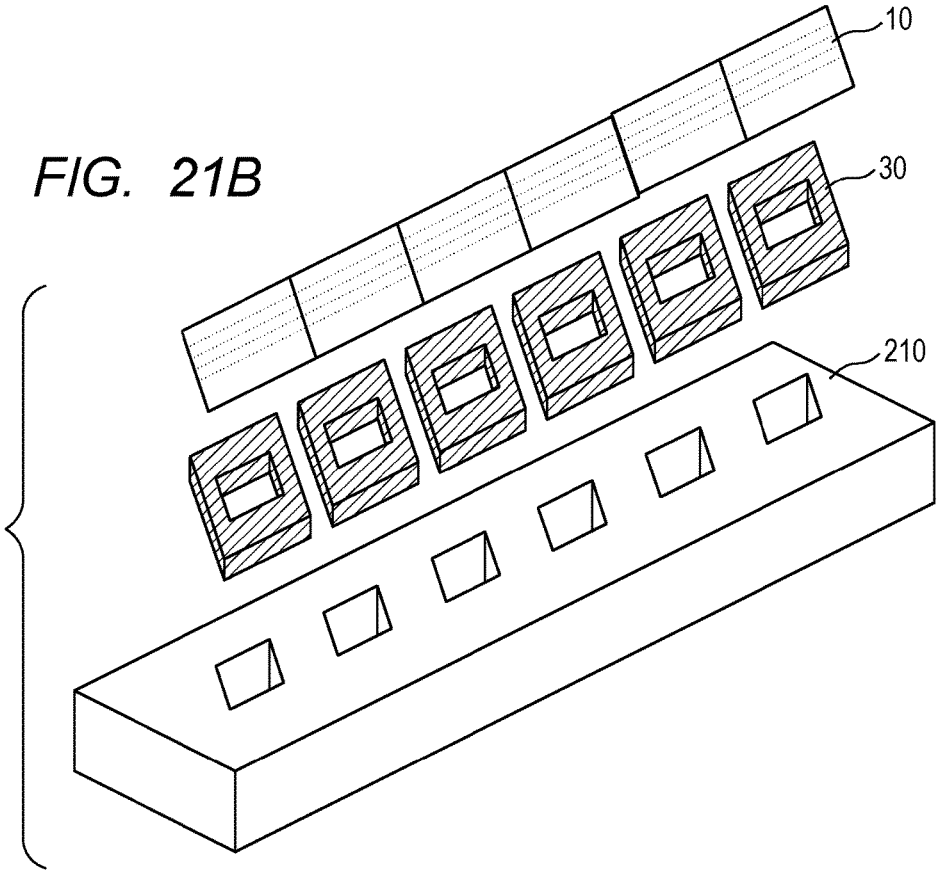

FIGS. 21A and 21B are schematic perspective views of the liquid ejection head of the first embodiment of the present invention, schematically illustrating the configuration thereof. More specifically, FIG. 21A is a schematic perspective view of the liquid ejection head for ejection liquid such as ink and FIG. 21B is an exploded schematic perspective view of the liquid ejection head.

Figure 22A:
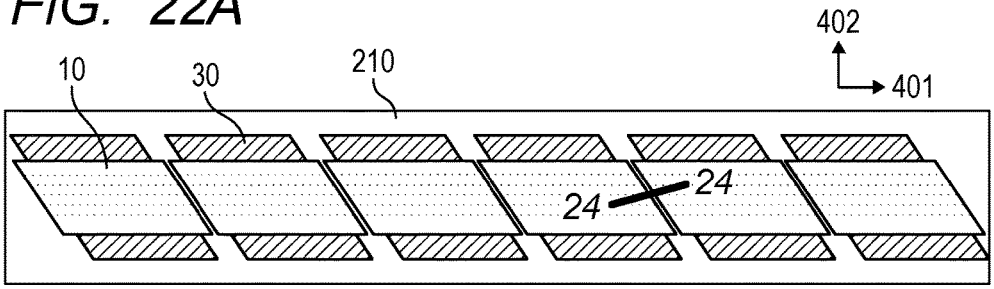
FIGS. 22A, 22B, 22C, and 22D are schematic top views of the liquid ejection head according to the first embodiment of the present invention.

The liquid ejection head 13 illustrated in FIGS. 21A and 21B includes a plurality of recording element boards 10, a plurality of support members 30 and a flow channel forming member 210. The number of the recording element boards 10 is the same as the number of the support members 30. The recording element boards 10 are supported by the respective support members 30 and the plurality of support members 30 are arranged side by side on the single flow channel forming member 210. FIGS. 22A through 22D are schematic top views of the liquid ejection head 3, representing four different exemplar shapes and four different exemplar arrangements that can be used for the recording element boards 10 of the liquid ejection head 3 of this embodiment. In the instance of FIG. 22A, recording element boards 10 having a parallelogrammic profile are arranged in a row. The expression of a "parallelogrammic profile" as used in the description of this example refers to a quadrangle each of whose angles formed by adjacent sides thereof is not orthogonal. In the following description, the direction in which the recording element boards 10 are arranged to form a row in the liquid ejection head 3 will be referred to as longitudinal direction 401 and the direction perpendicular to the longitudinal direction 401 in a plane parallel to the surfaces of the recording element boards 10 will be referred to as scanning direction 402.

Figure 22B:
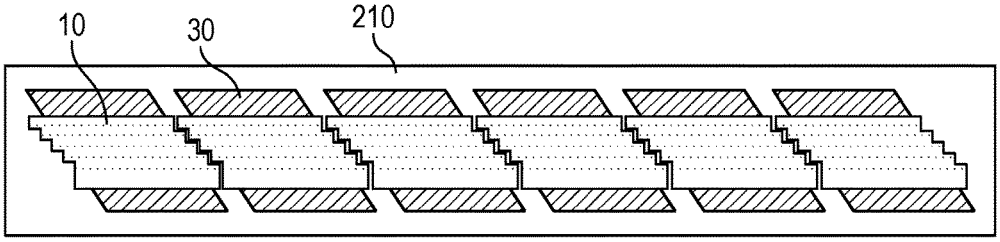
Figure 22C:
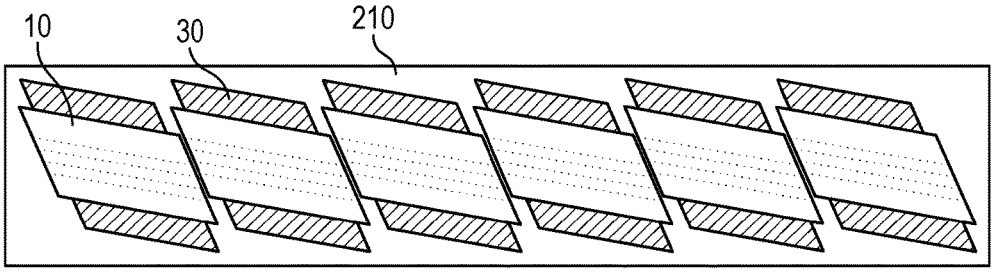
Figure 22D:
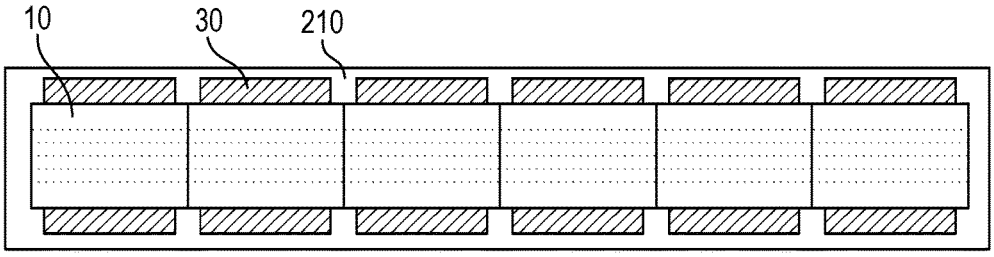

In the instance of FIG. 22B, recording element boards 10, each having a shape where the sides of one of the pairs of oppositely disposed sides run in parallel with each other whereas the sides of the other pair are formed by step-like bent lines, are arranged to form a row. In the instance of FIG. 22C, while recording element boards 10 having a parallelogrammic profile are arranged in a row as in FIG. 22A, any two adjacently located recording element boards 10 are displaced from each other in the scanning direction 402. In the instance of FIG. 22D, rectangular recording element boards 10 are arranged in a row.

In each of the instances of FIGS. 22A through 22C, any two adjacently located recording element boards 10 at least partly overlap each other both in the longitudinal direction and in the scanning direction. In the instance of FIG. 22D, any two adjacently located recording element boards 10 overlap each other only in the longitudinal direction.

Figure 23A:
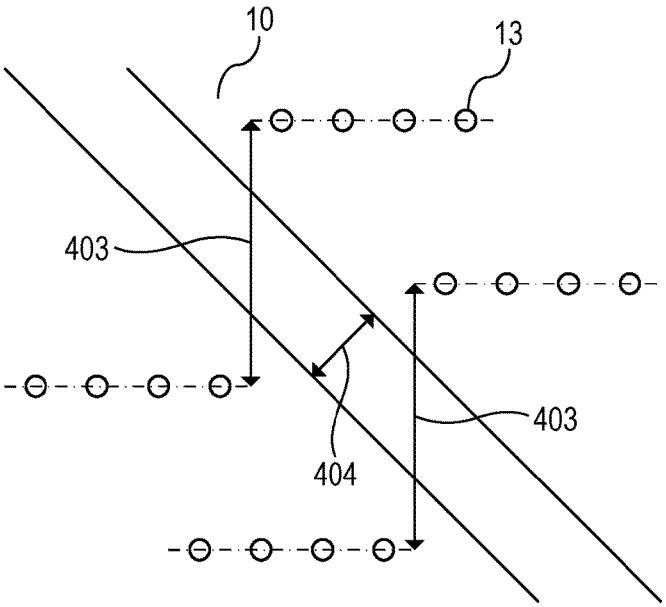
FIGS. 23A and 23B are schematic illustrations of the positional displacement of some of the rows of ejection ports of the liquid ejection head according to the first embodiment of the present invention.
Figure 23B:
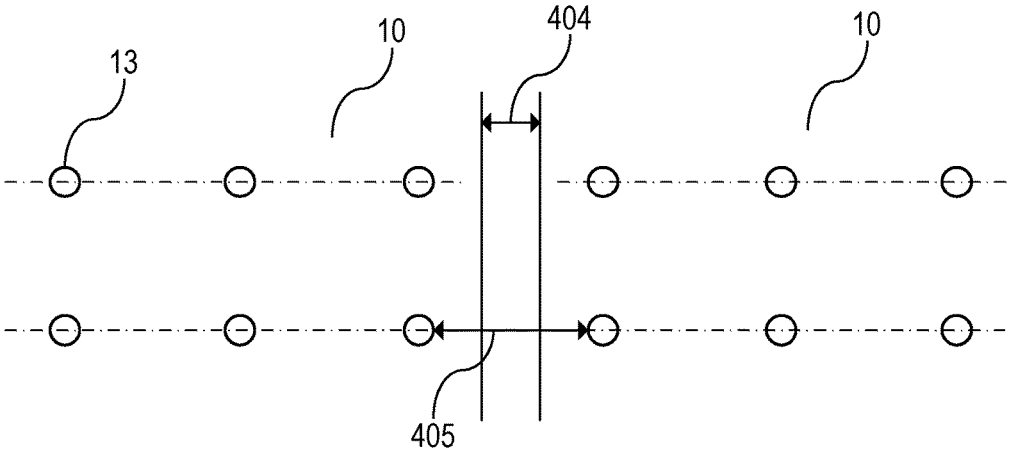

FIGS. 23A and 23B are schematic illustrations of positional displacement of rows of ejection ports of liquid ejection head 3. FIG. 23A is an enlarged schematic view of two adjacently located recording element boards 10 having a profile same as that of recording element boards 10 illustrated in FIG. 22A, representing the width of displacement 403 of the corresponding rows of ejection ports. As illustrated in FIG. 23A, displacement of rows of ejection ports appear in neighboring areas of the recording element boards 10 and the smaller the inter-element distance 404, which is the distance between the adjacently located recording element boards 10, the smaller the width of displacement 403 of rows of ejection ports. In other words, a smaller inter-element distance 404 is so much better for reducing width of displacement 403 of rows of ejection ports. The above description is applicable not only to the instance of FIG. 22A but also generally to liquid ejection heads 3 where adjacently located recording element boards 10 at least partly overlap each other both in the longitudinal direction and in the scanning direction as in the instances of FIGS. 22B and 22C.

FIG. 23B is an enlarged schematic view of a neighboring area of two adjacently located recording element boards 10 in the instance of FIG. 22D. While no positional displacement takes place among rows of ejection ports in the instance of FIG. 23B, a smaller inter-element distance 404 is so much better as in the case of the liquid ejection head to which FIG. 22A is applicable. This is because the smaller the inter-element distance 404, the smaller the gap 405 between adjacently located rows of ejection ports in a neighboring area. While a liquid ejection head 3 where adjacently located recording element boards 10 at least partly overlap each other both in the longitudinal direction and in the scanning direction as illustrated in FIG. 22A will be described below, the instance of FIG. 23B can also provide advantages similar to the those of the liquid ejection head of FIG. 22A.

Now, the characteristics of this embodiment will be described in greater detail below.

Figure 24:
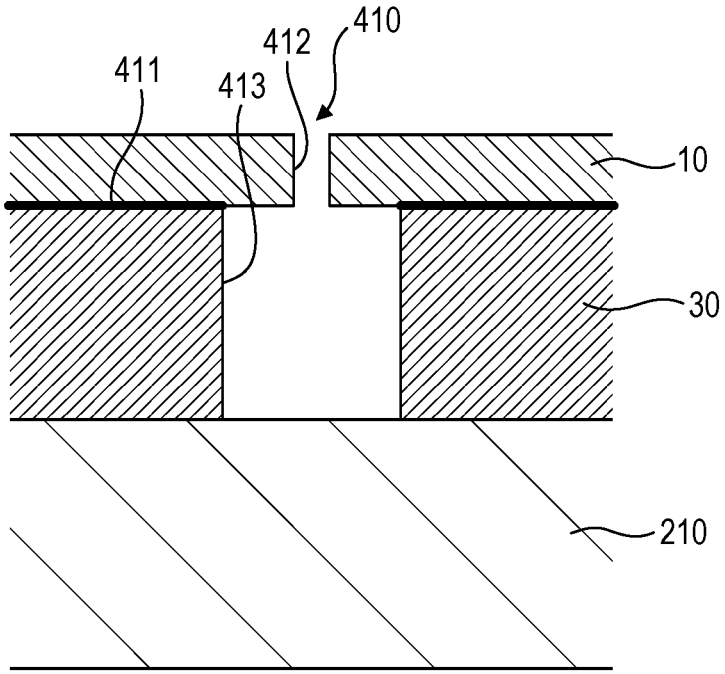
FIG. 24 is a schematic cross-sectional lateral view of a neighboring area of two adjacently located recording element boards according to the first embodiment of the present invention.

FIG. 24 is a schematic cross-sectional lateral view of a neighboring area of two adjacently located recording element boards 10 of the first embodiment. As illustrated in FIG. 24, in the gap area 410 between the two adjacently located recording element boards 10, the contacting surfaces 411 of the recording element boards 10 and the support members 30 are separated away from the oppositely disposed edges 412 of the recording element boards 10. In other words, the oppositely disposed edges 412 of the recording element boards 10 project outwardly from the corresponding edges 413 of the support members 30 to make the distance (gap) between the adjacently located recording element boards 10 smaller than the distance (gap) between the adjacently located support members 30.

Each of the recording element boards 10 has a circuit and other components prepared in advance in a wafer process (semiconductor process) and is typically formed by using silicon. Any of various etching and dicing techniques are typically employed to produce the circumferential profile of the recording element boards 10. On the other hand, the support members 30 are prepared by machining and/or molding. Resin or metal such as SUS is typically used to produce support members 30. Thus, the processing accuracy of the recording element boards 10 is higher than the processing accuracy of the support members 30.

Referring to FIG. 24, if the edges of the recording element boards 10 do not project outwardly from the edges of the support members 30, the accuracy of the inter-element distance 404, which is the distance between the two adjacently located recording element boards 10 is determined by the processing accuracy of the support members 30 and the mounting position alignment accuracy of the recording element boards 10. This is because the support members 30 can interfere with each other if an attempt is made to reduce the inter-element distance 404 so as to be smaller than the distance that is nominally limited by the processing accuracy of the support members 30 and the mounting position alignment accuracy of the recording element boards 10.

To the contrary, when the edges 412 of the recording element boards 10 project outwardly from the edges of the support members 30 as in this embodiment, the accuracy of the inter-element distance 404 between the adjacently located recording element boards 10 is not limited by the processing accuracy of the support members 30. The accuracy of the inter-element distance 404 is determined by the processing accuracy of the recording element boards 10 and the mounting position alignment accuracy of the recording element boards 10. With this arrangement, if the processing accuracy of the support members 30 and the mounting position alignment accuracy of the recording element boards 10 are relatively low, the support members 30 would not interfere with each other so long as the edges of the recording element boards 10 project outwardly from the edges of the support members 30 by a distance greater than the dimensional tolerance of the support members 30. Thus, the distance between the two adjacently located recording element boards 10 can be reduced by configuring the liquid ejection head 3 in a manner as will be described below.

Figure 25A:
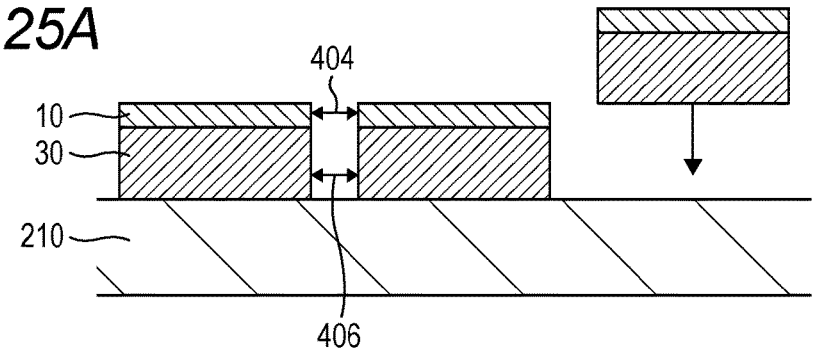
FIGS. 25A, 25B, 25C and 25D are schematic illustrations of some of the advantages of the liquid ejection head according to the first embodiment of the present invention.
Figure 25B:
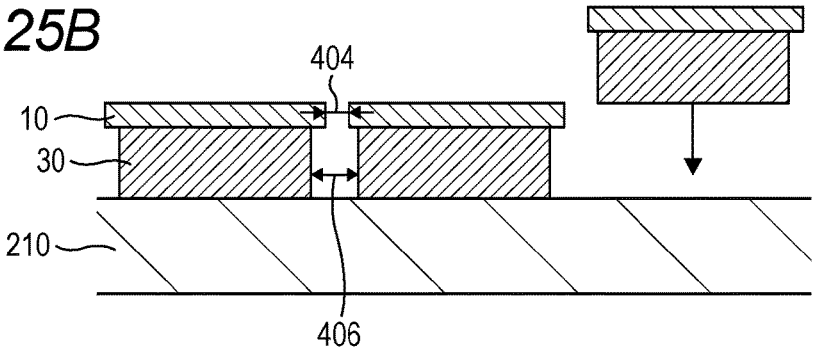
Figure 25C:
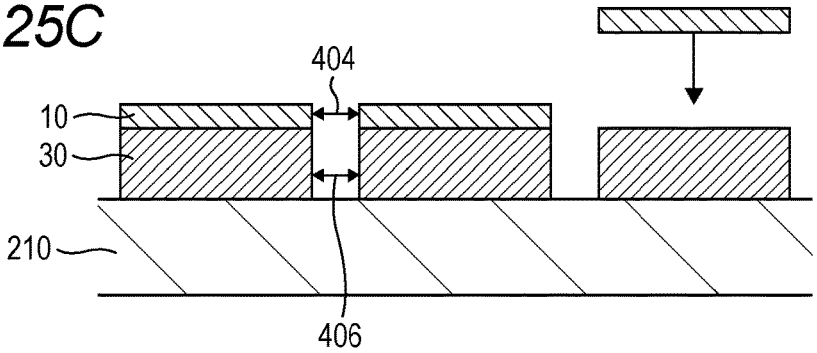
Figure 25D:
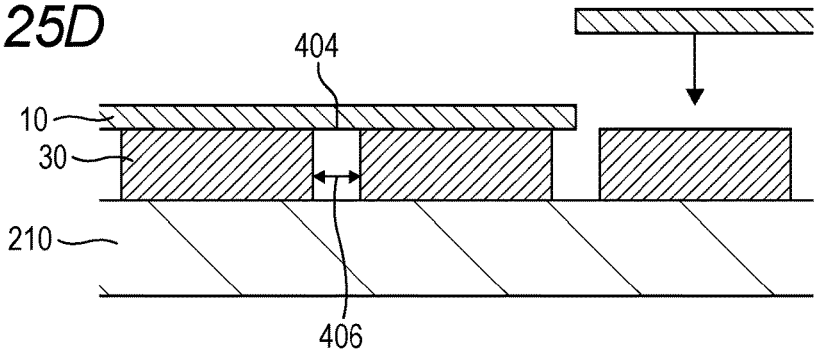

FIGS. 25A, 25B, 25C and 25D are schematic illustrations of some of the advantages of the liquid ejection head of this embodiment and represent side views of neighboring areas of adjacently located recording element boards 10 of the liquid ejection head. More specifically, FIG. 25A represents a first comparative example and FIG. 25B represents a first example of this embodiment, while FIG. 25C represents a second comparative example and FIG. 25D represents a second example of this embodiment. FIGS. 25A and 25B represent instances where support members 30 carrying respective recording element boards 10 mounted thereon are arranged on a flow channel forming member 210 and FIGS. 25C and 25D represent instance where recording element boards 10 are mounted on respective support members 30 arranged on a flow channel forming member 210.

Assume here that the processing accuracy of the support members 30 is ±0.1 mm and the processing accuracy of the recording element boards 10 is ±0.01 mm, while the mounting alignment accuracy of the support members 30 is ±0.1 mm and the mounting alignment accuracy for the recording element boards 10 is ±0.01 mm.

In the comparative example illustrated in FIGS. 25A and 25C, the edges of the recording element boards 10 do not project outwardly from the edges of the support members 30. In these instances, a value greater than 0.4 mm obtained by adding the processing accuracy of each of the support members 30 to the mounting alignment accuracy of each of the support members 30 and doubling the sum needs to be selected for the inter-member distance 406, which is the distance between the two adjacently located support members 30. In other words, the inter-element distance 404 is at least equal to 0.4 mm.

As for the first example of the this embodiment illustrated in FIG. 25B, the inter-element distance 404 may be made to be equal to 0.04 mm obtained by adding the processing accuracy of each of the recording element boards 10 to the mounting alignment accuracy of each of the recording element boards 10 and doubling the sum. Therefore, the inter-element distance 404 of the first example of this embodiment can be reduced by 0.36 mm from the inter-element distance 404 of the comparative example illustrated in FIG. 25A.

As for the second example of this embodiment illustrated in FIG. 25D, the inter-element distance 404 may be made to be equal to be 0.22 mm obtained by adding the processing accuracy of each of the recording element boards 10 to the mounting alignment accuracy of each of the support members 30 and doubling the sum. Therefore, the inter-element distance 404 of the second example of this embodiment can be reduced by 0.18 mm from the inter-element distance 404 of the comparative example illustrated in FIG. 25C.

In the instance of FIG. 25D, if the mounting alignment accuracy of the recording element boards 10 is low to a certain extent, the inter-element distance 404 can further be reduced by raising the mounting alignment accuracy of the support members 30. For example, the inter-element distance 404 can be made to be equal to 0.04 mm by making the mounting alignment accuracy of each of the recording element boards 10 to be equal to 0.1 mm and making the mounting alignment accuracy of each of the support members 30 to be equal to 0.01 mm. In this example, the member mounting step that requires a high degree of accuracy needs to be executed only once.

As described above, the inter-element distance 404 can be reduced by making the edges 412 of the recording element boards 10 project outwardly relative to the edges 413 of the support members 30 to by turn reduce the displacement width 403 of the rows of ejection ports in neighboring areas of adjacently located recording element boards 10. Therefore, the displacement width in neighboring areas of adjacently located recording element boards 10 in the direction of scanning recording mediums 2 can be reduced to by turn reduce the displacement width 403 of rows of ejection ports without being subjected to limitations imposed by the processing accuracy of support members 30 and the mounting alignment accuracy of the support members 30. Then, as a result, problems such as unevenness of images at positions thereof corresponding to neighboring areas of recording element boards 10 can be minimized and high quality images can be produced.

Additionally, with this embodiment, the problem that the adhesive agent employed to bond the recording element boards 10 and the support members 30 creeps up from the gaps 410 separating adjacently located recording element boards 10 to the first surfaces of the recording element boards 10 where ejection ports 13 are arranged can be suppressed. Thus, when an adhesive agent is employed to bond the recording element boards 10 and the support members 30, the arrangement of this embodiment where the edges of the recording element boards 10 are made to project outwardly from the edges of the corresponding support members 30 provides the advantage as described below. Namely, if the adhesive agent comes out from the bonded surfaces, the adhesive agent that comes out is forced to remain on the rear surfaces of the edge portions of the recording element boards 10 that project from the respective support members 30 to consequently suppress the problem of the adhesive agent creeping up from the gaps 410.

Desirably, a plurality of support members 30 are arranged on a single flow channel forming member 210. Then, support members 30 can accurately be arranged in the longitudinal direction 401 to make it possible to produce high quality images.

The length of the part of the flow channel forming member 210 where recording element boards 10 are arranged side by side is preferably not smaller than the maximum width of recording mediums 2 that can be set in position in the recording apparatus 1000. Such an arrangement allows improvement in the quality of the image to be recorded in areas thereof that correspond to the neighboring areas of adjacently located recording element boards 10 and the high quality image can be recorded across the entire width of a recording medium 2.

While the recording element boards 10 are individually replaceable in this embodiment, the present invention is not limited to such an arrangement. For example, a liquid ejection head 3 of which the recording element boards 10 are not individually replaceable but the support members 10 can advantageously be individually processed can also provide advantages similar to those of this embodiment.

Thus, the requirement to be satisfied by the configuration of this embodiment is only that the edges of adjacently located recording element boards 10 project outwardly from the edges of corresponding support members 30. As illustrated in FIGS. 22A through 22D, the support members 30 can be made to stably support the recording element boards 10 by making the edges of support members 30 project outwardly from the edges of the corresponding recording element boards 10 at the sides where no adjacently located recording element boards 10 are found. Additionally, each of the support members 30 can also be made to stably support the flexible wiring board 40 bonded to the recording element board 10 as illustrated in FIGS. 9A and 9B. As described above in detail, recording element boards 10 are preferably made to project outwardly relative to corresponding support members 30 at the sides where the recording element boards 10 are arranged side by side. On the other hand, support members 30 are preferably made to project outwardly from corresponding recording element boards 10 at the sides where no adjacently located recording element boards 10 are arranged (at the sides where support members are bonded to respective flexible wiring boards 40).

In the following description, one of any two adjacently located recording element boards 10 will be referred to as the first recording element board and the other will be referred to as the second recording element board. Similarly, the support member 30 supporting the first recording element board will be referred to as the first support member and the support member 30 supporting the second recording element board will be referred to as the second support member. Then, the first and second support members are arranged side by side on the flow channel forming member 210. Additionally, the edge of the first recording element board located close to the second recording element board preferably projects toward the second recording element board from the edge of the first support member located close to the second support member. Similarly, the edge of the second recording element board located close to the first recording element board preferably projects toward the first recording element board from the edge of the second support member located close to the first support member.

However, the present invention is by no means limited to the modes of arrangement illustrated in FIGS. 22A through 22D and the present invention is also applicable to an arrangement where each of the recording element boards 10 projects outwardly from the corresponding support member 30 along all the circumference thereof.

(Second Embodiment)

Figure 26A:
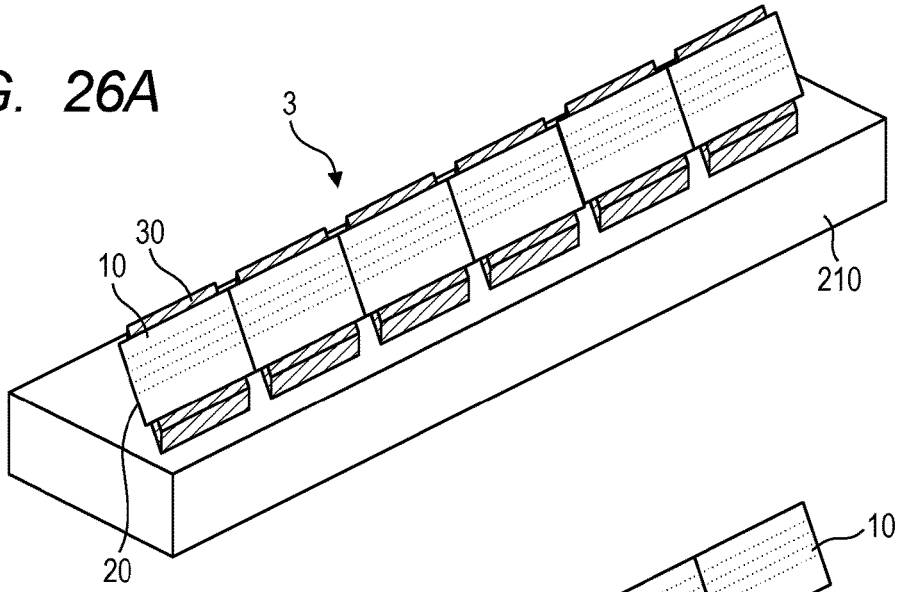
FIGS. 26A and 26B are schematic perspective views of the liquid ejection head according to the second embodiment of the present invention, schematically illustrating the configuration thereof.
Figure 26B:
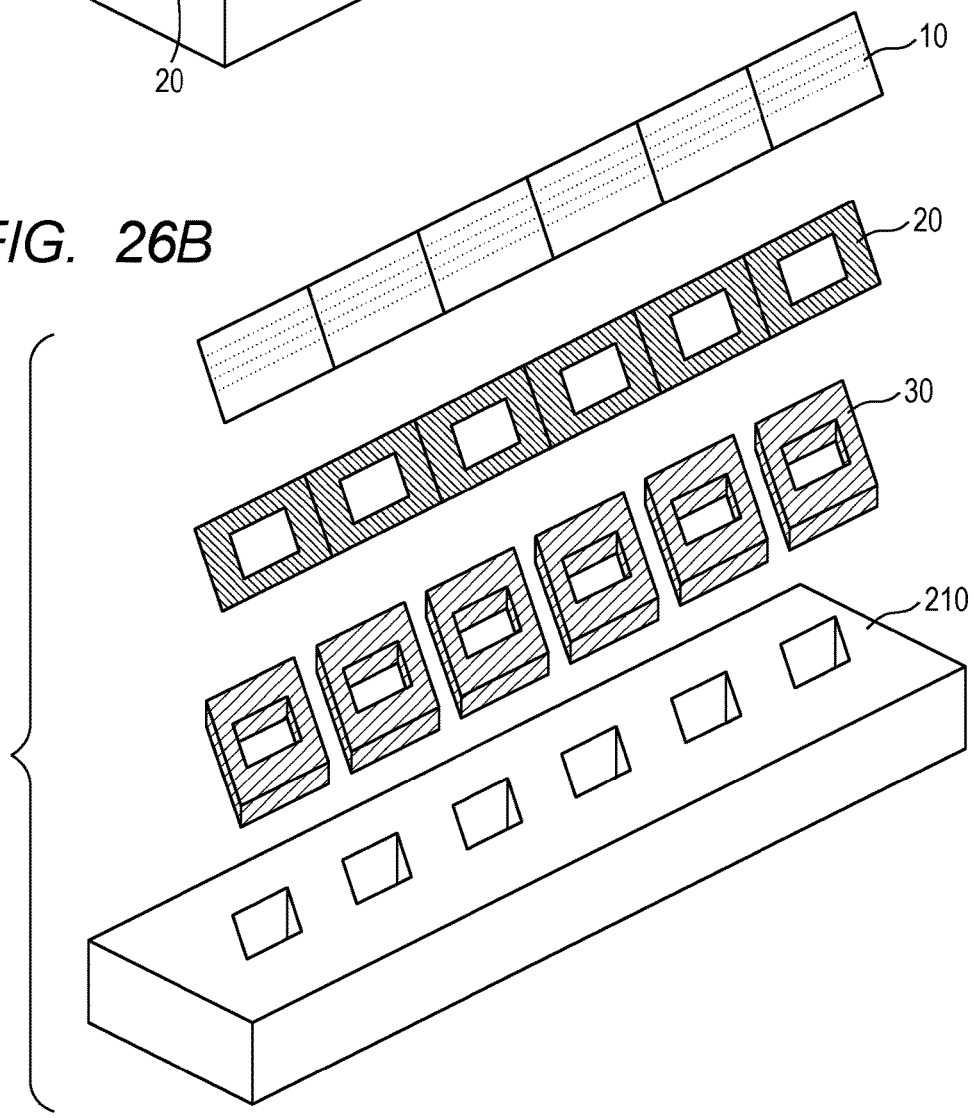
Figure 27A:
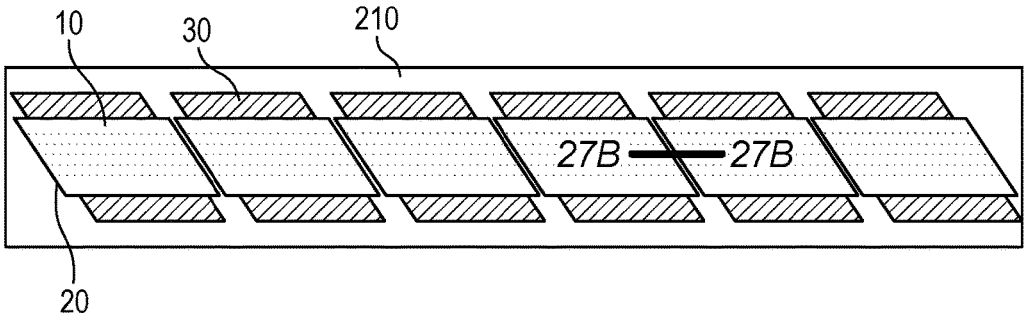
FIGS. 27A and 27B are schematic views of some of the recording element boards arranged side by side according to the second embodiment of the present invention.
Figure 27B:
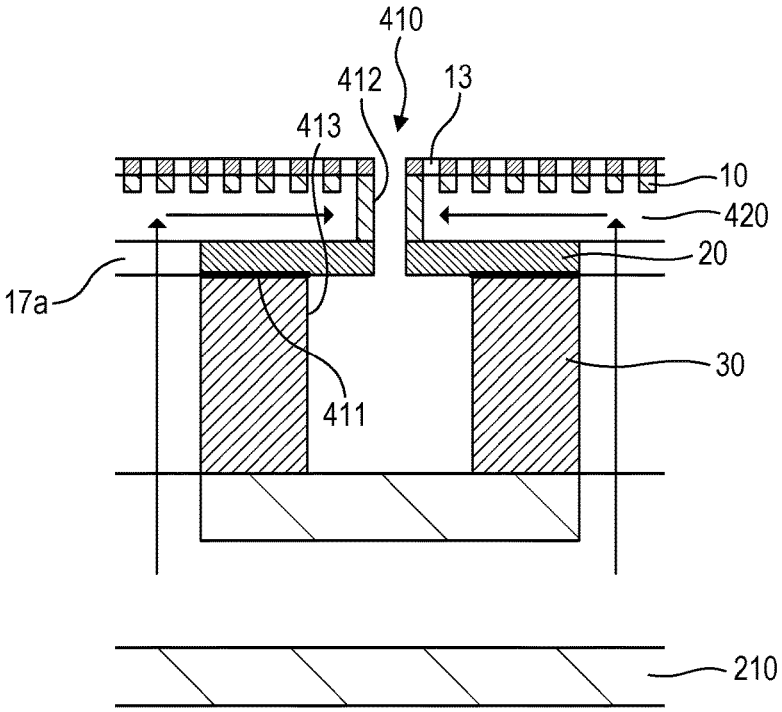

FIGS. 26A and 26B and FIGS. 27A and 27B schematically illustrate the second embodiment of liquid ejection head according to the present invention. FIGS. 26A and 26B are schematic illustrations of the liquid ejection head. More specifically, FIG. 26A is a schematic perspective view of the liquid ejection head and FIG. 26B is an exploded schematic perspective view of the liquid ejection head. On the other hand, FIGS. 27A and 27B are schematic illustrations of adjacently located recording element boards. More specifically, FIG. 27A is a schematic top view of the liquid ejection head and FIG. 27B is a schematic cross sectional view taken along line 27B-27B in FIG. 27A.

As illustrated in FIGS. 26A and 26B and FIGS. 27A and 27B, the liquid ejection head of this embodiment differs from the liquid ejection head of the first embodiment in that a lid member 20 is arranged between the recording element boards 10 and the support members 30. Additionally, in the liquid ejection head of this embodiment, a back side supply channel 420 for supplying liquid to the ejection ports 13 of each recording element board 10 is arranged on the rear surface of the recording element board 10 and the lid member 20 operates as lid for the back side supply channels 420 of the recording element boards 10. Furthermore, the lid member 20 is provided with supply ports 17*a* for supplying liquid to the back side supply channels 420. The supply ports 17*a* are typically made to communicate with the supply channels arranged in the insides of the support members 30. The lid member 20 is made of resin film and has a thickness smaller than the thickness of the support members 30. The thickness of the lid member 20 is preferably not more than 1 mm, more preferably not more than 0.1 mm.

In the liquid ejection head 3 of this embodiment, ejection ports 13 are formed in the parts of each recording element board 10 that project outwardly from the respective edges of the corresponding support member 30. Since the back side supply channels 420 are covered by the lid member 20, liquid can be supplied to the ejection ports 13 in the outwardly projecting parts of the recording element boards 10.

As in the description of the first embodiment, assume here that one of two adjacently located recording element boards 10 will be referred to as the first recording element board and the other will be referred to as the second recording element board and that the support member 30 that supports the first recording element board will be referred to as the first support member and the support member 30 that supports the second recording element board will be referred to as the second support member. Note that the lid member 20 is arranged between the first recording element boards and the respective support members along with the back side supply channels 420 formed on the surfaces of the first recording element boards located close to the respective first support members as supply channels for supplying liquid to the recording elements to cover the back side supply channels 420.

Note that the lid member that is the lid covering the back side supply channels 420 is a member having a thickness smaller than the thickness of the support members 30 so that it can be processed with a degree of process accuracy substantially equal to that of the recording element boards 10. For example, the lid member 20 can be formed by processing a silicon substrate. If so, the thickness of the lid member 20 can be made to be not greater than 1 mm. Silicon substrates can be processed by means of lithography, blade dicing which is a technique for processing wafers, or laser. Any of these techniques can ensure a degree of processing accuracy substantially equal to that of processing recording element boards 10. Alternatively, the lid member 20 can be formed by processing resin film. If such is the case, the thickness of the lid member 20 can be made to be not less than 0.1 mm. Resin film can be processed by means of lithography, blade dicing for processing wafers, or laser as in the case of processing silicon substrates. Any of these techniques can also ensure a degree of processing accuracy substantially equal to that of processing recording element boards 10. The recording element boards 10 and the lid member 20 are preferably bonded to each other without using any liquid adhesive agent. Then, the adhesive agent that is used to bond the recording element boards 10 and the lid member 20 can effectively be prevented from penetrating into the supply channels in the recording element boards 10 and the lid member 20.

In this embodiment, ejection ports 13 are arranged on the parts of the recording element boards 10 that respectively project outwardly from the edges 413 of the corresponding support member 30. Due to this arrangement, the distance separating the ejection ports 13 of any two adjacently located recording element boards 10 of this embodiment can be further reduced if compared with the first embodiment. Then as a result, the displacement width of the rows of ejection ports in a neighboring area of any two adjacently located recording element boards 10 can be further reduced.

Consider an instance where the inter-element distance 404 between two adjacently located recording element boards 10 is 0.02 mm and an instance where the inter-element distance 404 between two adjacently located recording element boards 10 is 0.2 mm as in the above description of the first embodiment. In these instances, ejection ports 13 are arranged at respective positions separated by 0.05 mm from an edge of a recording element board 10. When the angle formed by two obliquely disposed sides of each recording element board 10 is 45 degrees, the displacement width of two adjacent rows of ejection ports will be respectively about 0.17 mm and about 0.42 mm. Thus, if compared with the first embodiment, the displacement width can remarkably be reduced. As described above, the displacement width of this embodiment does not depend on the processing accuracy and the mounting alignment accuracy of the support members 30. Thus, the displacement width of any two adjacently located recording element boards 10 in a neighboring area thereof as viewed in the direction of scanning direction of the corresponding recording mediums 2 can be reduced to thereby reduce the displacement width 403 of rows of ejection ports. Then, as a result, problems such as unevenness of images at positions corresponding to neighboring areas of recording element boards 10 can be minimized and high quality images can be produced.

Additionally, as in the first embodiment, the problem that the adhesive agent bonding the recording element boards 10 and the support members 30 creeps up to the first surfaces of the recording element boards 10 where ejection ports 13 are arranged from the gaps 410 separating any two adjacently located recording element boards 10 can effectively be suppressed.

Note here that ejection ports 13 can be arranged on the parts of the recording element boards 10 that project outwardly from the respective edges of the support members 30 also in the first embodiment as in this embodiment. If such is the case, supply channels need to be formed on the surfaces of the recording element boards 10 where ejection ports 13 are formed in order to supply liquid to the ejection ports 13 arranged on the outwardly projecting parts of the recording element boards 10. Then, however, while the height of the supply channels is maximally several tens of μm in the first embodiment, the height of the back side supply channels 420 of the second embodiment can be made to be about several hundreds of μm. This means that liquid can more sufficiently be supplied to the ejection ports 13 arranged in the parts of the recording element boards 10 projecting outwardly from the corresponding edges of the respective support members 30 in the second embodiment than in the first embodiment so that the image quality of the areas of the recorded image that correspond to the neighboring areas can be improved more satisfactorily in the second embodiment than in the first embodiment.

The rear surfaces where the back side supply channels 420 are formed refers to the substantive rear surfaces of the recording element boards 10 relative to the surfaces thereof where ejection ports 13 are formed. In other words, in an instance where a recording element board 10 is formed by sequentially laying a plurality of substrates one on the other, the rear surface is not the rear surface of the top substrate on the front surface of which ejection ports 13 are formed but the rear surface of the entire recording element board 10 produced after laying the substrates one after another and located opposite to the front surface where ejection ports 13 are formed. The distance between two adjacently located recording element boards 10 is equal to the distance between two adjacently located lid members 20 in the instance of FIG. 27B, the distance between two adjacently located recording element boards 10 may well be smaller than the distance between two adjacently located lid members 20.

(The manufacturing steps of the liquid ejection head of the second embodiment)

Figure 28:
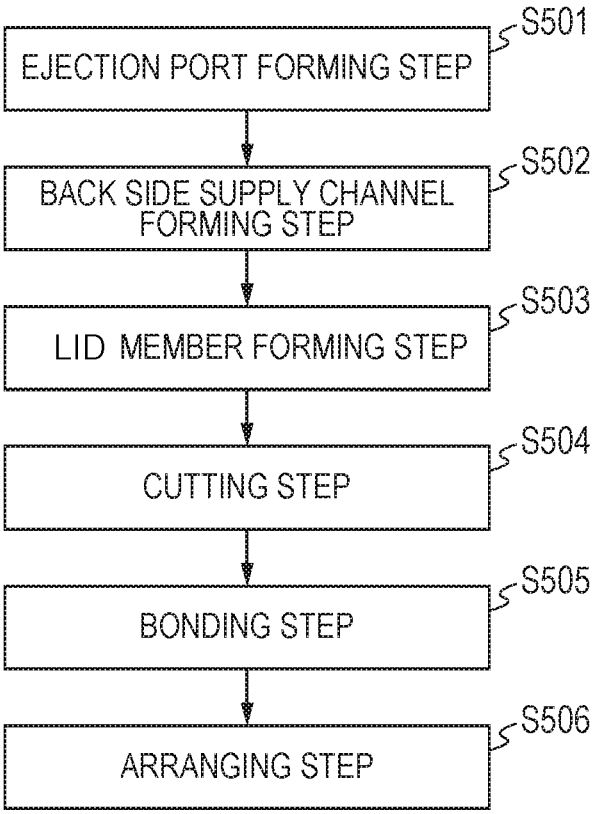
FIG. 28 is a flowchart, illustrating the steps of manufacturing the liquid ejection head according to the second embodiment of the present invention.

FIG. 28 is a flowchart illustrating the manufacturing steps of the liquid ejection head of the second embodiment.

Firstly, an ejection port forming step of forming ejection ports 13 on recording element boards 10 where circuits such as recording elements 15 necessary for bubbling liquid have been formed is executed (Step S501). At this time, the recording element boards 10 are in the form of a wafer. Subsequently, a back side supply channel forming step of forming back side supply channels 420 on the back surfaces of the recording element boards 10 is executed (Step S502). Then, a lid member forming step of forming a lid member 20 on the back surfaces of the recording element boards 10 is executed (Step S503). Thereafter, a cutting step of processing the recording element boards 10 to make them represent the designed proper outer profile and producing recording element boards 10 in the form of chips out of the recording element boards 10 in the form of wafer is executed (Step S504). Subsequently, a bonding step of bonding the recording element boards 10 to the respective support members 30 such that the lid member 20 is located vis-à-vis the support members 30 (Step S505). Finally, an arranging step of arranging the support members 30 to which the recording element boards 10 have been bonded side by side on a flow channel forming member 210 is executed (Step S506).

The liquid ejection head of the second embodiment is produced as a lid member 20 is formed on the rear surface of the recording element boards 10 in the lid member forming step (Step S503) prior to the bonding step (Step S505). Therefore, the displacement width of any two adjacently located recording element boards 10 can be reduced in the scanning direction to thereby reduce the displacement width of rows of ejection ports without depending on the processing accuracy and the mounting alignment accuracy of the support members 30. Then, as a result, problems such as unevenness of images at positions corresponding to neighboring areas of recording element boards 10 can be minimized and high quality images can be produced.

When the lid member 20 is formed by using a silicon substrate, a lid member 20 formed by using a silicon substrate in the form of a wafer can be bonded to recording element boards 10 in the form of a wafer. Therefore, the number of steps can be reduced if compared with an instance where lid members 20 are bonded to respective recording element boards 10 that are in the form of so many chips.

When the lid members 20 is formed by using resin film, the lid member 20 that is in the form film can be bonded to the wafer of recording element boards 10 to produce a laminate. Then, as a result, the number of steps can be reduced if compared with the instance of bonding individual lid members 20 respectively to recording element boards 10 on a chip by chip basis just like the above description of forming lid members 20 by a silicon substrate.

Note that the manufacturing steps described for this embodiment is only exemplar manufacturing steps and the present invention is by no means limited to the above-described manufacturing steps. For example, the sequence of executing an ejection port forming step (Step S501), a back side supply channel forming step (Step S502), a lid member forming step (Step S503) and a cutting step (Step S504) may not necessarily be the one described above for this embodiment. The only requirement to be satisfied for the manufacturing steps is that a lid member forming step (Step S503) needs to be executed before a bonding step (Step S505).

A liquid ejection head 3 and a recording apparatus 1000 as described above in detail can find applications in the field of printers, copying machines, facsimile machines equipped with a telecommunication system and word processors having a printer section. Furthermore, a liquid ejection head 3 and a recording apparatus 1000 according to the present invention can also find applications in the field of industrial recording apparatus formed by combining various processing devices in a complex way. For example, they can find applications in the field of producing biochips, in the field of electronic circuit printing and so on.

Thus, according to the present invention, the edges of the recording element board project outwardly from the edges of the support member supporting the respective recording element boards in the direction in which the support members are arranged side by side. Due to this arrangement, the distance between any two adjacently located recording element boards can be defined by referring to the processing accuracy and the mounting alignment accuracy of recording element boards that are higher than the processing accuracy and the mounting alignment accuracy of support members. Then, as a result the distance between any two adjacently located recording element boards can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002944, filed Jan. 8, 2016, and Japanese Patent Application No. 2016-236639, filed Dec. 6, 2016, which are hereby incorporated by reference herein in their entirety.

What is claimed is:

1. A liquid ejection head comprising:

first and second recording element boards having recording elements for generating energy to be utilized for ejection of liquid;

first and second support members for respectively supporting the first and second recording element boards; and a flow channel forming member carrying thereon the first and second support members arranged side by side, wherein the edge of the first recording element board located at the side of the second recording element board projects toward the second recording element board from the edge of the first support member located at the side of the second support member, and wherein a liquid supply channel is formed on the surface of the first recording element board located vis-à-vis the first support member to supply liquid to the recording elements and a lid member is arranged between the first recording element board and the first support member to form part of the liquid supply channel.

2. The liquid ejection head according to claim 1, wherein the edge of the second recording element board located at the side of the first recording element board projects toward the first recording element board from the edge of the second support member located at the side of the first support member.

3. The liquid ejection head according to claim 1, wherein the lid member has a thickness smaller than the thickness of the first support member.

4. The liquid ejection head according to claim 1, wherein the thickness of the lid member is not more than 1 mm.

5. The liquid ejection head according to claim 1, wherein the lid member is formed by using resin film.

6. The liquid ejection head according to claim 1, wherein the first recording element board includes an ejection port forming member having ejection ports for ejecting liquid and a substrate having the recording elements, and the substrate has on the rear surface thereof, located oppositely from the surface carrying the recording elements arranged thereon, a liquid supply channel for supplying liquid to the recording elements and a liquid collection channel for collecting liquid from the recording elements.

7. The liquid ejection head according to claim 1, wherein the circumferential profiles of the first and second recording element boards are parallelogrammic.

8. The liquid ejection head according to claim 7, wherein the edge of the first recording element board contiguous to the edge located at the side of the second recording element board does not project relative to the corresponding edge of the first support member.

9. The liquid ejection head according to claim 1, wherein the liquid ejection head is a page wide type liquid ejection head, and a common supply channel for supplying liquid to the first and second recording element boards and a common collection channel for collecting liquid from the first and second recording element boards are arranged at the flow channel forming member.

10. The liquid ejection head according to claim 1, wherein the first recording element board includes an ejection port forming member having ejection ports for ejecting liquid and a substrate having the recording elements, and the processing accuracy of the substrate of the first recording element board is higher than the processing accuracy of the first support member.

11. The liquid ejection head according to claim 1, wherein ejection ports for ejecting liquid are formed at a projecting part of the first recording element board.

12. The liquid ejection head according to claim 1, wherein a plurality of recording element boards including the first and second recording element boards are linearly arranged on the flow channel forming member.

13. The liquid ejection head according to claim 1, wherein the first recording element board has pressure chambers respectively having the recording elements in the inside thereof and the liquid in the pressure chambers is circulated between the inside and the outside of the pressure chambers.

14. A liquid ejection device comprising a liquid ejection head and supply means for supplying liquid to the liquid ejection head, the liquid ejection head comprising:

first and second recording element boards having recording elements for generating energy to be utilized for ejection of the liquid;

first and second support members for respectively supporting the first and second recording element boards; and a flow channel forming member carrying thereon the first and second support members arranged side by side, wherein the edge of the first recording element board located at the side of the second recording element board projects toward the second recording element board from the edge of the first support member located at the side of the second support member, and wherein a liquid supply channel is formed on the surface of the first recording element board located vis-à-vis the first support member to supply liquid to the recording elements and a lid member is arranged between the first recording element board and the first support member to form part of the liquid supply channel.

15. A liquid ejection head comprising:

first and second recording element boards having recording elements for generating energy to be utilized for ejection of liquid;

first and second support members for respectively supporting the first and second recording element boards; and a flow channel forming member carrying thereon the first and second support members arranged side by side, wherein the edge of the first recording element board located at the side of the second recording element board projects toward the second recording element board from the edge of the first support member located at the side of the second support member, wherein the circumferential profiles of the first and second recording element boards are parallelogrammic.

16. The liquid ejection head according to claim 15, wherein the edge of the second recording element board located at the side of the first recording element board projects toward the first recording element board from the edge of the second support member located at the side of the first support member.

17. The liquid ejection head according to claim 15, wherein the first recording element board includes an ejection port forming member having ejection ports for ejecting liquid and a substrate having the recording elements, and the substrate has on the rear surface thereof, located oppositely from the surface carrying the recording elements arranged thereon, a liquid supply channel for supplying liquid to the recording elements and a liquid collection channel for collecting liquid from the recording elements.

18. The liquid ejection head according to claim 15, wherein the edge of the first recording element board contiguous to the edge located at the side of the second recording element board does not project relative to the corresponding edge of the first support member.

19. The liquid ejection head according to claim 15, wherein the liquid ejection head is a page wide type liquid ejection head, and a common supply channel for supplying liquid to the first and second recording element boards and a common collection channel for collecting liquid from the first and second recording element boards are arranged at the flow channel forming member.

20. The liquid ejection head according to claim 15, wherein the first recording element board includes an ejection port forming member having ejection ports for ejecting liquid and a substrate having the recording elements, and the processing accuracy of the substrate of the first recording element board is higher than the processing accuracy of the first support member.

21. The liquid ejection head according to claim 15, wherein ejection ports for ejecting liquid are formed at a projecting part of the first recording element board.

22. The liquid ejection head according to claim 15, wherein a plurality of recording element boards including the first and second recording element boards are linearly arranged on the flow channel forming member.

23. The liquid ejection head according to claim 15, wherein the first recording element board has pressure chambers respectively having the recording elements in the inside thereof and the liquid in the pressure chambers is circulated between the inside and the outside of the pressure chambers.

24. A liquid ejection device comprising a liquid ejection head and supply means for supplying liquid to the liquid ejection head, the liquid ejection head comprising:

first and second recording element boards having recording elements for generating energy to be utilized for ejection of the liquid;

first and second support members for respectively supporting the first and second recording element boards; and a flow channel forming member carrying thereon the first and second support members arranged side by side, wherein the edge of the first recording element board located at the side of the second recording element board projects toward the second recording element board from the edge of the first support member located at the side of the second support member, and wherein the circumferential profiles of the first and second recording element boards are parallelogrammic.

* * * * *